US012202034B2

(12) United States Patent
Campbell et al.

(10) Patent No.: US 12,202,034 B2
(45) Date of Patent: Jan. 21, 2025

(54) APPARATUS AND METHOD FOR USE IN CASTING OF METALS AND/OR METAL ALLOYS

(71) Applicant: Sylatech Limited, Kirkbymoorside (GB)

(72) Inventors: John Campbell, Ledbury (GB); William Benjamin Shaw, York (GB)

(73) Assignee: Sylatech Limited, Kirkbymoorside (GB)

( * ) Notice: Subject to any disclaimer, the term of this patent is extended or adjusted under 35 U.S.C. 154(b) by 314 days.

(21) Appl. No.: 17/619,657

(22) PCT Filed: Jun. 19, 2020

(86) PCT No.: PCT/GB2020/051491
§ 371 (c)(1),
(2) Date: Dec. 16, 2021

(87) PCT Pub. No.: WO2020/254823
PCT Pub. Date: Dec. 24, 2020

(65) Prior Publication Data

US 2022/0305548 A1 Sep. 29, 2022

(30) Foreign Application Priority Data

Jun. 20, 2019 (GB) ..... 1908822
Dec. 11, 2019 (GB) ..... 1918188

(51) Int. Cl.
*B22D 1/00* (2006.01)
*B22D 18/04* (2006.01)
*B22D 18/06* (2006.01)
*B22D 35/04* (2006.01)
*B22D 35/06* (2006.01)

(52) U.S. Cl.
CPC ..... *B22D 1/007* (2013.01); *B22D 18/04* (2013.01); *B22D 18/06* (2013.01); *B22D 35/045* (2013.01); *B22D 35/06* (2013.01)

(58) Field of Classification Search
CPC ..... B22D 1/00; B22D 1/007; B22D 18/04; B22D 18/06; B22D 35/04; B22D 35/045; B22D 35/06
USPC ..... 164/113, 133, 134, 335, 337
See application file for complete search history.

(56) References Cited

U.S. PATENT DOCUMENTS 4,967,827 A 11/1990 Campbell
2007/0209771 A1 9/2007 Makino et al.
2008/0202644 A1 8/2008 Grassi et al.

*Primary Examiner* — Kevin P Kerns
(74) *Attorney, Agent, or Firm* — GableGotwals

(57) ABSTRACT

An apparatus and method is disclosed for forming an item in a mould using a casting process, typically a counter gravity casting system. Heating assembly, transfer assembly and mould filling assembly can be used in combination. The transfer assembly includes apparatus and method for removing sedimentation from the liquid metal and/or metal alloy received from the heating assembly and extracting the same prior to the metal and/or metal alloy reaching the mould filling assembly at which the same is supplied to fill a cavity of a mould and which, once filled, can be slid to a location to cool and thereby make available the mould filling assembly for the next mould to be filled. This apparatus and method provide an efficient, high throughput system, along with high quality cast items.

16 Claims, 17 Drawing Sheets

SECTION A-A
SCALE 1:5

SECTION C-C
SCALE 1:5

SECTION D-D
SCALE 1:5

SECTION E-E
SCALE 1:2

SECTION A-A

APPARATUS AND METHOD FOR USE IN CASTING OF METALS AND/OR METAL ALLOYS

CROSS REFERENCE TO RELATED APPLICATIONS

This United States application is the National Phase of PCT Application No. PCT/GB2020/051491 filed 19 Jun. 2020, which claims priority to British Patent Application No. 1908822.8 filed 20 Jun. 2019 and Application No. 1918188.2 filed 11 Dec. 2019, each of which is incorporated herein by reference.

BACKGROUND OF THE INVENTION

The invention to which this application relates is to an apparatus and a method for use in the casting of liquid material, such as a metal and/or metal alloys, into one or more articles using casting apparatus into which the material is provided in a liquid state and which subsequently hardens to take the impression and shape of the mould to form the final article.

In particular, although not necessarily exclusively, the apparatus and method relate to improvements to a system known as a counter-gravity system.

In counter-gravity casting systems of the type to which the application relates there is provided an assembly by which the metal and/or metal alloy is heated into a molten condition, in one embodiment using a dry hearth melter. The liquid metal and/or metal alloy is then transferred from that assembly to an assembly in which the liquid is introduced into a mould cavity which is filled with the liquid metal, with the liquid metal and/or metal alloy being introduced into the cavity in an upwards direction and against the effect of gravity. Conventionally, this is achieved by the use of a pump or a pressurised vessel which is situated below the mould and a pressure increase is used to force the liquid metal upwardly into a passage which connects to the cavity in the mould and this passage is typically referred to as a riser tube.

The mould typically includes one (or more) aperture(s) in its base which act as an ingate in connection with the riser tube which allows the movement of the liquid metal into the mould cavity to fill the same at least to a predefined level, or indeed to fill all of the cavity.

While the counter-gravity casting of metal using a mould is a well-known process, the problems which can be experienced can deter the use of the same. For example, with regard to the mould filling assembly, a well-known problem is that the mould needs to be removed from the riser tube once the mould cavity has been filled with the liquid metal to the required extent and this can cause problems but does need to be performed as soon as practically possible so as to allow a subsequent mould to be presented to the riser tube and then filled, and so on in order to allow a satisfactory and commercially viable production rate to be achieved.

However it is found in practice that if the liquid metal in the filled mould has not solidified by the time at which the mould is required to be removed from the riser tube, then when attempts are made to separate the riser tube and the mould the liquid metal will simply pour out of the ingate of the mould and hence at least partially empty the mould cavity when attempts are made to separate the riser tube and the mould.

Previous attempts which have been made to overcome this problem include delaying the removal of the mould from the riser tube for a sufficient time in order to allow all of the liquid metal in the cavity to solidify prior to separation of the mould from the riser tube. However this approach has a number of disadvantages in that there is a significant reduction in productivity due to the need to wait a period of time before the metal solidifies and/or it is found that a convection system can be created whilst the mould is connected to the riser tube between the source of the liquid metal at high temperature underneath the mould and the cooling denser metal in the mould itself. This can lead to a circulating flow of cold metal slipping down the riser tube and hot metal rising up the riser tube and into the cooling metal in the mould cavity and the arrival of the hot liquid metal into the cavity can melt the solidifying metal in the cavity and so extend the time for metal solidification and/or cause shrinkage defects in the casting. As a result, the selection of this method of involving a relatively long hold time in the mould cavity with the mould in connection with the riser tube is usually not economic and may not even be a viable technique.

Another approach has been to provide the ingate in a form which allows the solidification of the liquid metal in the vicinity thereof relatively quickly by the provision of a passive device which, may for example, narrow the ingate sufficiently to accelerate the loss of heat without narrowing it so much that jetting or turbulent fountaining of the liquid metal into the mould occurs. Alternatively, or in addition, metal chill blocks and/or active water-cooled chilling means may be located adjacent or near to the ingate, but it is found that the blocks and/or the connections to the water-cooling device interfere with the movement and handling of the mould and there is also still required to be provided to allow the solidification of the liquid metal at the ingate to occur before the mould can be separated from the riser tube and so there is still an increase in time of the production cycle time.

A further approach is to provide a slide gate which is located as part of the apparatus intermediate the liquid metal supply and the mould and which can be selectively used for the sealing of the ingate and, for example, in the case of casting liquid metal in the form of aluminium, the gate can be formed of steel or can consist of a sand core. This approach has the disadvantage of requiring modification of the apparatus, most typically the mould in order to incorporate the slide gate. Furthermore, in certain designs the slide gate may have a central hole which carries a penny shape of liquid metal with it when the slide gate is moved to a closed position and this lost metal has to be subsequently removed to join the foundry returns for re-melting. With regard to steel slide gates then they are required to be retrieved and cleaned prior to re-use and are subject to wear while those which are formed from a sand core have to be formed for each mould. For moulds which are formed of green sand, and in which the sand is tolerably pliable, a mechanical piston situated in the mould but some distance from the ingate can be actuated to squeeze the ingate and hence seal off the mould.

Alternatively or in addition to the above, the mould can be filled via its side. After filling, the mould can be rolled over, rotating 180 degrees to provide the advantage of achieving an improved temperature gradient to allow efficient feeding of the casting and to allow the mould to be detached quickly from the apparatus without the necessity for sealing apparatus to be used. However, if expanding gas from cores is forced into the liquid metal, the bubbles tend to rise and leave a bubble trail which can form a linear crack in the casting. As the mould is rotated, the bubbles can take a sideways path and finally, as the mould becomes completely inverted, the bubbles may then move in the opposite direction. The result of this is that a long zig-zag bubble trail, constituting a potentially major defect, is created which can adversely affect several parts of the casting and hence threaten its strength and provide leakage paths. A further downside of the rollover system is the necessary provision of extension tubes for the supply of the liquid metal which are necessarily insulated and heated to avoid undue loss of temperature for this part of the transfer of the liquid metal into the mould. These tubes are usually electrically heated but can be complex to operate and commonly the electrical heating elements fail as a result of burn out, electrical faults and/or leakage of metal.

Furthermore, in all of the above described approaches whilst they can be used with moulds made from either sand or metal they tend not to be usable with investment moulds, especially those made from plaster and contained in a steel box.

Problems can also arise with the metal and/or metal alloy heating assembly. In particular, the current invention relates to the use of apparatus which allows a metal or: metal alloy to be provided in a form which encourages the formation of articles which are free of, or have reduced risk of, contamination and/or faults.

The use of liquid alloys such as liquid aluminium alloys is well-known to be adversely affected by the presence of oxides which are held in suspension in the liquid material. The oxides originate from the surface of the liquid and are entrained into the body of the liquid involving the immersion of the oxide films as double films and conventionally referred to as bi-films.

As the entrainment mechanism always and necessarily involves the creation of bi-films by a folding process, or an impingement process, it follows that the dry upper surfaces of the two oxide films are presented face-to-face which prevents the bonding of the same and therefore the bi-film interface constitutes a crack in the liquid at the interface between the dry ceramic surfaces which have not bonded. In contrast, the outer interfaces of the two films of the bi-film, are in perfect atomic contact with the liquid adjacent to the same which is a consequence of the outer surfaces of the bi-film having been originally on the underside of the original surface film which grew off the liquid, atom by atom, as molecules of oxygen arrive and react with the liquid aluminium surface. Thus, the outer, wetted surfaces of the bi-film can act as substrates for the precipitation and growth of second phases and intermetallics. Typically, investigation into the second phases and intermetallics, has shown that each has nucleated and grown on the bi-film. The presence of the bi-film in the newly formed phase is often seen as a crack, and often mistakenly taken as conclusive evidence that the phase is brittle and must have suffered sufficient stress so as to have caused a fracture. Thus, the terms "brittle beta-iron intermetallics" or "brittle silicon particles" are commonly but erroneously seen in the descriptions of microstructures of this type.

Bi-films are found to exist in a wide variety of liquid molten metals such as steels in which the large scale entrainment of bi-films occurs during the pouring of steels from the melting furnace into the ladle, several metres below. However, fortunately, this huge entrainment of defects does not lead to permanent damaging of the properties of the steel. This is due to the fact that the various oxides involved all have densities significantly lower than steel, thus providing a strong natural buoyancy, and so mainly float out, within a few minutes. For this reason, steels are relatively clean and have tensile elongations in the region of 50%. In contrast, in aluminium alloys, aluminium oxide (alumina $Al_20_3$), is denser than liquid aluminium, tending to make the bi-film sink. However, the thin layer of air between the two films of the bi-film tend to encourage the same to float and thus, the combination of these two aspects create a substantially neutral buoyancy which causes the bi-films to effectively "swim about" in suspension in the liquid metal alloy for hours, or even days. This slowness to sediment means that the bi-film population in the liquid survives to create a population of cracks in the solidifying metal. It therefore follows that aluminium alloys naturally contain a significant population of bi-film cracks, thereby conventionally limiting its mechanical properties and usage. Furthermore, the tensile elongation of many aluminium alloys is measured in low single figures, typically 3 to 5%, and it is generally acknowledged that elongation values above the common aerospace minimum specification of 7% are difficult to achieve.

Thus it is known that the bifilm population normally present in all aluminium metal and alloy arises from two sources. The 'primary' oxides are from the thick oxide skins on the surfaces of charge materials such as ingots and recycled scrapped castings. The rolling up of the liquid metal around the submerging pieces of charge automatically creates large bifilms. The second source arises from the turbulent handling and pouring of the liquid metal, folding-in and impinging-in bifilms. These secondary bifilms are generally confetti-like: smaller and dispersed. Both these sources require to be addressed to achieve metal and alloy castings of the required properties.

In many conventional foundries, the primary oxide skins on the charge materials cannot be prevented from entering the melt when using crucible or bath type furnaces because the charge materials, complete with their oxide skins, are all loaded into the furnaces, from where they are difficult to extract from the melt. So-called rotary degassing techniques can float a proportion of these large bifilms to the surface, from where they can be scraped off, but not all can be guaranteed to be floated out in this way.

The furnace design which can eliminate all primary oxide skins is the dry hearth melter. The melter can take various forms: for instance a vertical shaft furnace, or a horizontally-charged recuperating twin burner furnace. The vertical shaft furnace has the benefit of being simple and efficient. In the furnace the dry heated hearth is the location at which melting occurs. Liquid metal escapes from the oxide skin of the piece of charge, and runs down the gentle slope of the hearth and into a receiving bath. The primary oxide skin remains on the hearth. After a time, the accumulation of skins is removed and thrown into a dumpster for disposal. In this way, the furnace achieves the separation of the primary skins and the melted metal, each going its separate way.

In many conventional foundries, the newly melted metal would be poured into a ladle mounted on a fork lift truck, transported to a casting station, and the ladle tilted to pour the metal into the casting station. The two pouring actions would introduce immense populations of bifilms, greatly degrading the properties of the final castings.

The deleterious pouring actions can be eliminated or at least reduced by the connection of the melting furnace to the casting station by a horizontal channel, generally known as a launder. The launder is kept filled with liquid metal to a controlled height, and is heated by overhead electrical heaters. Sedimentation techniques have been used previously to provide cleaning processes for liquid metals involving sedimentation in a bath of relatively large area in which the liquid metal and/or metal alloy is contained and in which the liquid moves only slowly thereby facilitating the sedimentation. However, the problem with this arrangement is that the furnace requires to be cleaned out after it has become full of sediment and, for very dirty melts, cleaning out may be required to be performed almost daily, whereas cleaner melting stock might require only a weekly clean-out of the furnace. The cleaning process is most typically a scraping process involving very hard manual work, which is also hot and dangerous and in addition, the cleaning process requires a period of production downtime and a period of settlement prior to the apparatus been moved back into full production and therefore this known scheme is not commercially attractive.

BRIEF SUMMARY OF THE INVENTION

An aim of the present invention is therefore to provide a solution to the abovementioned problems and, preferably, to provide a solution which is suitable for use in all types of moulds and thereby allow the advantages to be obtained by use of the system.

A further aim of the system is to provide a compact transfer assembly between the heating assembly and the mould filling assembly and a method of use of the same, which provides an efficient and controllable "cleaning" effect to be achieved in a metal and/or metal alloy, such as a liquid aluminium alloy, so as to reduce the deleterious impact of the bi-films in the same.

A further aim is to provide the apparatus and a method of use in a form which supplies passively de-gassed metal and/or metal alloy from the transfer assembly to the mould filling assembly.

A further aim is to provide the apparatus and a method of use in a form which is operable at a rate required to supply a continuously repetitive casting operation.

In a first aspect of the invention there is provided an apparatus for use in the casting of metal and/or metal alloy, said apparatus including a heating assembly in which the metal and/or metal alloy is changed into a substantially liquid state, a mould filling assembly in which the metal and/or metal alloy is moved into a mould to be cast and a transfer assembly to transfer the said metal and/or metal alloy by allowing the material to flow between the heating assembly and the mould filling assembly and said transfer assembly allows for the sedimentation of one or more bi-films in the said metal and/or metal alloy during said transfer and wherein the transfer assembly includes a launder and means to create a portion in said launder which allows the said one or more bi-films the opportunity to separate from the flow of the metal and/or metal alloy and settle in a vessel or sump from which the bi-film sediment is extracted.

Typically said transfer assembly allows for the passive degassing of said metal and/or metal alloy during said transfer as a result of the conditions created by the launder, and transfer assembly as a whole, for the metal and/or metal alloy in the molten, liquid condition.

In one embodiment the said means in the launder acts as an Oxide Sedimentation Pump (OSP).

In one embodiment the extraction of the sediment is via a tube through which the sediment is drawn up.

In one embodiment the heating assembly is provided in the form of a dry hearth melter apparatus and from which the liquid metal and/or metal alloy is transferred via said transfer assembly to the mould filling assembly.

In one embodiment, the heating assembly includes a shaft furnace with a dry hearth and the charge materials to form the molten liquid material, such as a metal alloy are placed into the same and the apparatus is heated.

The charge materials are typically preheated as they move down the shaft by the heat from the heating means moving up the shaft so as to form, effectively, a counter flow heat exchanger.

Typically, the apparatus is provided, and its operation controlled, so that the charge material is melted on the hearth and following which the molten material runs down a slope and into a holding bath in such a manner that the oxide skin of the charge remains on the hearth.

Typically, the apparatus includes a containment means into which the accumulated oxide skins on the hearth are placed, having been removed from the hearth.

Typically, the apparatus allows the segregation of the oxide skins by moving the same in a different direction to the movement of the molten material.

In one embodiment the said mould filling assembly includes a mould of the desired shape for the item which is to be cast from the metal and/or metal alloy, and a crucible furnace to which the liquid metal and/or metal alloy is supplied from the transfer assembly.

Typically the crucible furnace has a number of heating means located therewith so as to heat the liquid metal and/or metal alloy in the furnace to the required casting temperature.

In one embodiment a pump is located in or adjacent to the furnace in order to move the liquid metal and/or metal alloy via a riser tube and into the mould.

Typically the mould filling assembly is located with respect to a surface so that when the mould is filled with the metal and/or metal alloy the mould can be detached from the mould filling assembly and slid along said surface to cool and for the metal and/or metal alloy to solidify and thereby free up the mould filling assembly to perform the next moulding steps in a new mould.

In one embodiment the assembly includes an Oxide Sedimentation Pump (hereafter referred to as an OSP). In one embodiment the extraction of the sediment from the vessel is achieved by the provision of a tube and applying a vacuum to an end, typically the upper end, of the tube and drawing up the sediment through the tube.

In an alternative embodiment a bubble lift mechanism is used to remove the sediment which preferably involves no moving parts.

In one embodiment, the bubble lift pump imparts bubbles into the molten material and which rise and carry sedimentation along with the same through a riser tube and thereby assist the flow of the flocculant volume of sediment through and from the molten material.

In one embodiment the overspill from the top of the tube is directed into an ingot mould where it can solidify.

In one embodiment, the removal of the sediment is provided by an automated system which requires no human intervention.

In one embodiment, the sedimentation technique is used for continuous production of quality metal alloys via a launder system.

In one embodiment the molten material transfers from the heating assembly to the launder system which in one embodiment is a long, heated channel at a predetermined height so as to avoid any fall of the liquid flow. Typically, the launder channel is provided along a substantially horizontal axis to allow distribution to required locations.

In one embodiment, the transfer assembly apparatus includes heating means to maintain the temperature of the molten material and preferably at a predetermined temperature which is as low as possible, whilst avoiding solidification of the molten material.

In one embodiment, the apparatus includes an oxide detrainment station at which a proportion of bi-films which are in suspension in the liquid will detrain and settle out of the molten material.

In one embodiment, the apparatus includes dosage means to allow the dosage into the liquid material of elements which promote sedimentation and preferably this occurs on a continuous basis via a wire feed which includes the required elements as part of the wire.

In one embodiment, the wire is an aluminium based alloy containing one or more elements which form compounds with aluminium and which nucleate and grow on bi-films. In one embodiment, the material elements include titanium and/or molybdenum and/or tungsten and/or iron. In particular, the addition of titanium is conveniently achieved by the introduction of a wire feed into the liquid metal in the launder a short distance ahead of the OSP. Aluminium alloy wire containing a convenient percentage of titanium is commercially available, also containing boron, the Al—Ti—B alloy forming a useful grain refining action for the finished castings.

In one embodiment, the apparatus includes guide means to guide the flow of the sediment to a collection area.

Thus, the apparatus effectively acts as an oxide pump to pump the oxide material in the form of sediment out of the molten material whilst, at the same time, preventing the formation of any further bi-films in the liquid material. The passive degassing of said metal and/or metal alloy during said transfer is achieved as a result of the conditions created by the launder, and transfer assembly as a whole, for the metal and/or metal alloy in the molten, liquid condition.

In a further aspect of the invention, there is provided an apparatus for the processing of a molten liquid material in the form of a metal and/or metal alloy which contains one or more oxide bi-films, said apparatus provided as a transfer assembly including a launder along which the substantially liquid metal and/or metal alloy flows, and wherein a portion of the launder allows for the separation of said one or more suspended bi-films in the said liquid metal and/or metal alloy material and the sediment of the said one or more bi-films separates from the flow and settles in a vessel to concentrate the bifilm sediment at a location from where they can be extracted.

In a further aspect of the invention there is provided apparatus for use in a counter gravity casting process, said apparatus including a mould filling assembly including a mould with a cavity therein, a furnace in which a metal and/or metal alloy in a liquid state is located, a passage in the form of a riser tube connecting the said furnace to the said cavity to allow liquid metal to pass therealong and into the mould cavity when an ingate of the mould is in register with the riser tube, and wherein a support surface is provided and located so as to be substantially level with an interface between the ingate of the said mould and the riser tube such that after the filling of the mould cavity to a desired extent, the supply of liquid metal is closed off and the mould is moved by a sliding action from a position in register with the said riser tube across the said support surface to a position thereon which is sufficiently remote from the riser tube so as to allow a further mould to then be placed in connection with the riser tube. In one embodiment the said support surface is a casting platen.

In one embodiment the supply of liquid metal and/or metal alloy is cut off by operation of a valve which, in one embodiment is located at an end of the riser tube which opposes the end at which the interface with the mould is located.

In one embodiment the said valve is located intermediate the source of the liquid metal and/or metal alloy and the riser tube.

In one embodiment the furnace provides a reservoir of the metal and/or metal alloy and a pressurised vessel and/or pump is provided which allows the control of the pressure of the supply of the liquid metal and/or metal alloy to the riser tube and mould cavity.

Typically cooling apparatus is provide and/or the support surface is of a form so as to encourage the solidification of the liquid metal at least adjacent to the mould ingate and to a sufficient extent to then allow the mould to be lifted clear from the support surface as a subsequent step.

In one embodiment there is provided an apparatus for use in counter-gravity moulding of a liquid metal, said apparatus including a metal supply in a liquid form, a means for providing the said liquid metal supply at one or more predefined pressures, a riser tube in connection with said liquid metal supply and having a free end for the location therewith of the mould which has a cavity which is to be filled by the liquid metal, a surface adjacent to the riser tube and at a level which is substantially the same as the level at which the connection between the mould and the riser tube is located such that, when the mould is filled to a sufficient extent and is required to be cooled, the said mould can be slid from the connection with the riser tube, across said surface without losing contact with the said surface to a location which is sufficiently remote from the riser tube so as to allow a further mould to be placed in connection with the said riser tube and filled with the liquid metal whilst the metal in the first mould cools.

In a further aspect of the invention there is provided a method of casting a metal and/or metal alloy item including a heating assembly, a mould filling assembly and a transfer assembly to transfer liquid metal and/or metal alloy from the heating assembly to the mould filling assembly, said steps including heating the metal and/or metal alloy charge in the heating assembly to a substantially liquid state, passing the liquid material along a launder channel of the transfer assembly to a furnace of the mould filling assembly, inducing the movement of the liquid metal into the mould via one or more riser tubes to fill the mould and wherein during the flow of the liquid metal and/or metal alloy along the transfer assembly, sedimentation of one or more bi-films in the said metal and/or metal alloy occurs in at least a portion of the launder channel and collecting said sedimentation separated from the metal and/or metal alloy material flow in a vessel or sump and extracting said bi-film sediment from the vessel or sump.

In one embodiment the rate of sedimentation can be increased by causing heavy precipitates to form on the outer, wetted surfaces of the bi-films, because these interfaces with the surrounding liquid tend to act as favoured substrates for many intermetallic or second phase particles. Thus the addition of heavy elements into solution in the liquid metal, such as iron, titanium, molybdenum or tungsten, is highly effective in aiding sedimentation.

In one embodiment the mould filling assembly includes a mould which is placed so as to align an ingate of the mould with an orifice of a riser tube of the mould filling assembly via which liquid metal and/or metal alloy is supplied from a furnace to the mould via a pump.

Typically the said orifice is substantially coincident in a horizontal plane with an adjacent substantially horizontal support surface.

Typically the liquid metal and/or metal alloy is provided at a first level in the riser tube, and then increasing the pressure applied to the liquid metal and/or metal alloy to move the same to a second level which is in the cavity in the mould, stopping the liquid metal supply and wherein the mould is slid sideways onto said support surface to a sufficient extent to move the mould clear of the riser tube and retaining the mould in contact with the said support surface until at least the liquid metal located in the cavity adjacent the said ingate solidifies.

In one embodiment the mould is retained in contact with the support surface until the majority or all of the metal and/or metal alloy in the mould cavity has solidified, or until it can be lifted safely from the casting platen 40.

Typically, the said position to which the mould is slid is sufficient as to allow a further mould to be presented to the riser tube and be filled by liquid metal using the method steps as defined herein.

In one embodiment the first level of the liquid metal (L1) is substantially level with the support surface.

In one embodiment the liquid metal is held at the level L1 by controlling the liquid metal supply at a pressure P1 and then is moved to the second level L2 by increasing the pressure of the liquid metal supply from P1 to P2. Typically the level L2 is substantially at the top of the mould cavity.

Typically the sliding action to move the mould to the required position on the support is in a horizontal direction or substantially horizontal direction such that the ingate of the mould is retained in contact with the support surface during the sliding movement.

Typically when the mould is to be removed, a control valve intermediate the liquid metal supply and the mould cavity is closed isolating the metal contained in the upper part of the riser tube, ensuring that metal cannot issue from the top of the riser tube. A subsequent, empty mould is located on the orifice of the riser tube and the method steps are repeated so as to fill the said second mould.

Typically, the above process can be repeated as often as required to fill the cavities of respective moulds sequentially. A significant advantage of the current invention is that the said method steps can be repeated for each mould without having to wait for the metal in the cavity of the previous mould or moulds to solidify as these moulds have been moved away from the orifice and the liquid metal supply and are able to cool and solidify over time without unduly affecting or delaying the productivity rate In one embodiment, the support surface is the top surface of a casting platen. In one embodiment the said support surface is formed of a metal such as steel which, in one embodiment, may be cooled by cooling means or alternatively, the support surface temperature is sufficient in itself to cause the cooling and solidification of the liquid metal at least adjacent to the ingate of the mould over time.

Typically the dimension and size of the said support surface along which the moulds are slid and then positioned during the cooling is selected to suit a particular production and capacity requirements in terms of the number of moulds which are required to be positioned on the same at any given time.

In one embodiment the said support surface is heat conducting.

In one embodiment, the riser tube and/or mould joint is provided with a seal which, in one embodiment, may be partially recessed into the mould. In one embodiment the seal is a heat resistant compressible gasket.

In a further aspect of the invention there is provided a method of providing a cleaning effect on a molten material, said method including the steps of providing the molten material to a cleaning station and at said cleaning station operating a pump to create a vacuum or a series of bubbles which pass through the said molten material to entrain and move sediment along with the same to a position in which the sediment is removed from the molten material and captured.

In a further aspect of the invention there is provided a method of casting a liquid metal and/or metal alloy, said method including the steps of: placing a mould so as to align an ingate of the mould with an orifice of a riser tube via which liquid metal is supplied from a liquid metal source to the mould, providing the said orifice substantially coincident in a horizontal plane with an adjacent substantially horizontal support surface, providing liquid metal at a first level in the riser tube, increasing the pressure applied to the liquid metal to move the same to a second level which is in the cavity in the mould, stopping the liquid metal supply and wherein the mould is slid sideways onto said support surface to a sufficient extent to move the mould clear of the riser tube and retaining the mould in contact with the said support surface until at least the liquid metal located in the cavity adjacent the said ingate solidifies.

In one embodiment the apparatus and methods as herein described are incorporated, in combination, or as independent features, in a counter gravity casting system.

BRIEF DESCRIPTION OF THE DRAWINGS

Specific embodiments of the invention are now described with reference to the accompanying drawings wherein.

DETAILED DESCRIPTION OF THE INVENTION

Figure 1A:
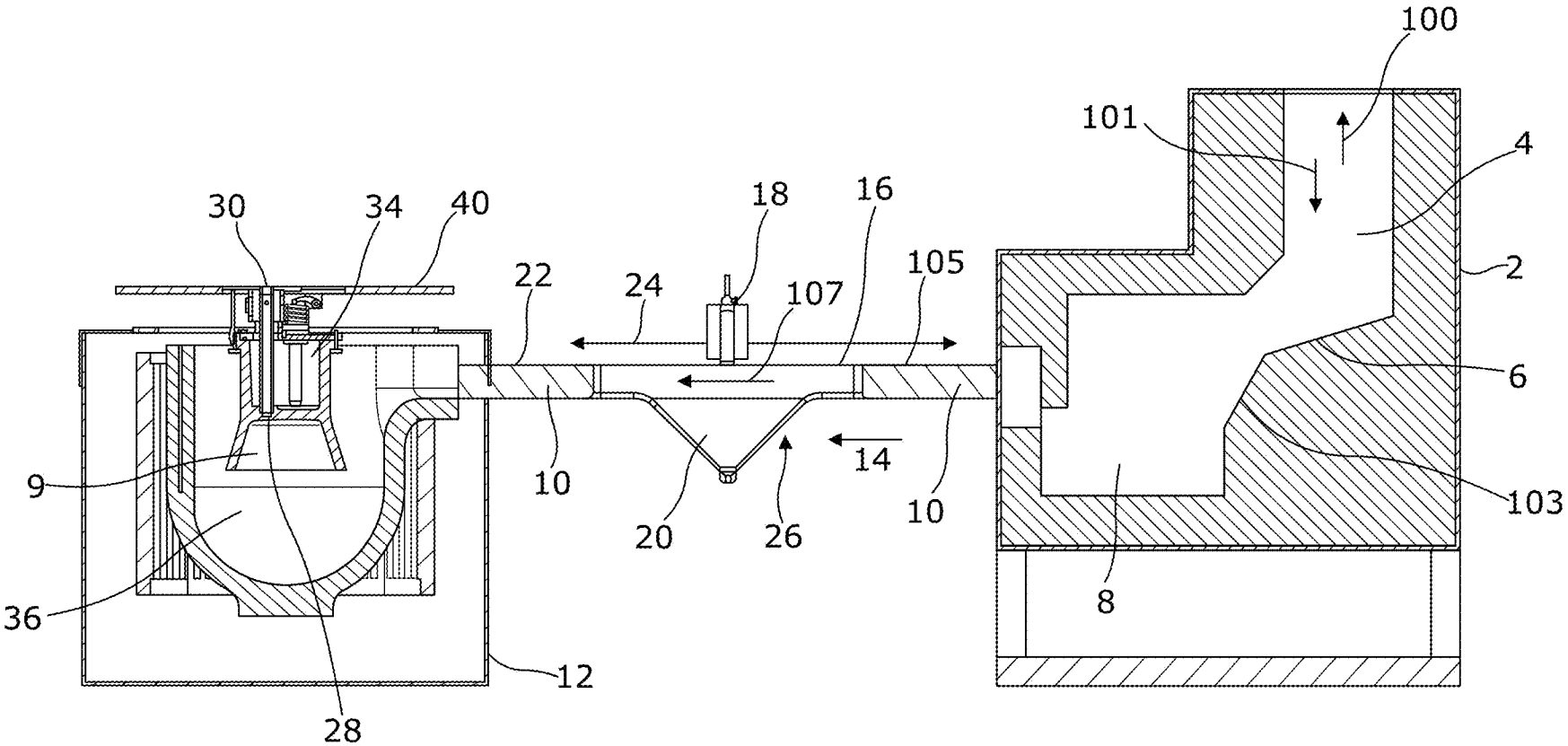
FIGS. 1*a-b* illustrate a counter gravity system an apparatus in accordance with one embodiment of the invention in side elevation and plan.
Figure 1B:
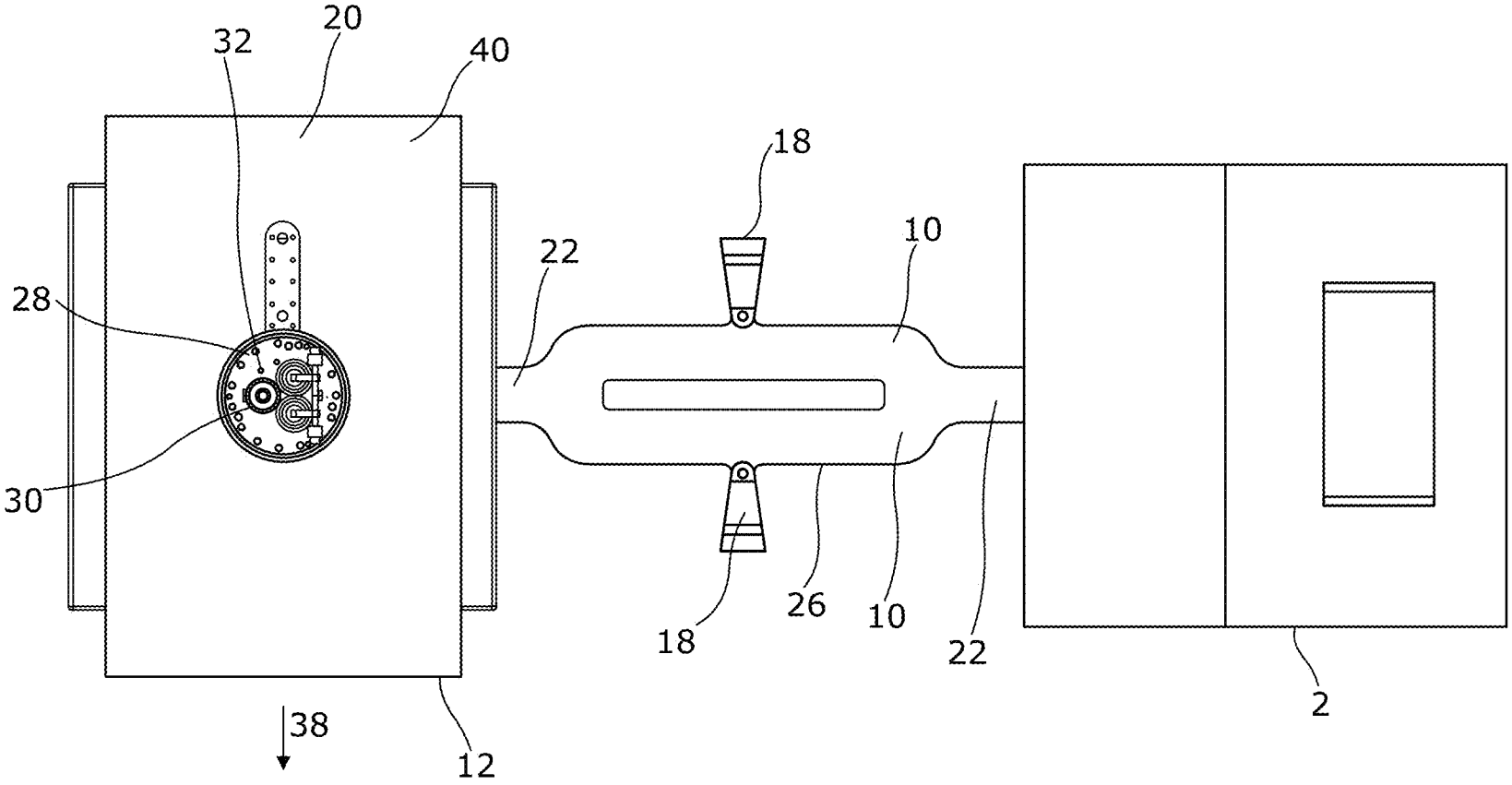

Referring firstly to FIGS. 1*a* and *b* there is illustrated a casting system in accordance with one embodiment of the invention. In this embodiment the system is a counter gravity casting system.

The system includes a heating assembly 2 in the form of a dry hearth tower which includes a flue 4 which allows gases to pass up through the descending charge, pre-heating the charge efficiently as a counter-flow heat exchanger. The use of the dry hearth 6 melting provides an advantage over crucible or bath melting because the primary oxide skins on the charge materials can be separated completely from the metal. The oxide skins remain on the sloping hearth 6 and are scraped off periodically. The molten metal and/or metal alloy, free from the primary oxides which would normally have been present, enters the refining system. Typically the dry hearth melter can maintain the melt level 8 constant to within a few millimetres and feed-back from the monitor of the metal level can be used to match the melting rate to the casting rate.

The transfer assembly 26 includes a launder or channel to allow the flow of the liquid metal and/or metal alloy from the heating assembly 2 to the mould filling assembly 12 in the direction of arrow 14. Along the launder there is provided a portion 18 which acts as an oxide sediment pump (OSP) 16 to allow sedimentation of oxide bifilms from the liquid metal and/or metal alloy in a controlled manner, together with extraction via a pump 18.

As the liquid metal and/or metal alloy flows, traversing over the top of a sump or vessel 20, the rate of descent of bifilms ensures that the larger, heavier bifilms have sufficient time to sink through the overlying flow and be captured by entering the sump or vessel 20. Their rate of descent can be controlled by the rate of addition of heavy alloy addition. The vacuum assisted pump 18 periodically lifts the sediment (the concentrated oxide and liquid aluminium mixture) out of the sump or vessel 20 and into a pigging ingot so that the cast sediment, is provided in a uniquely convenient ingot form to facilitate the recovery of the entrained aluminium.

In one embodiment the OSP channel or launder can be split into two channels or launders so reducing the metal speed by half and doubling the time for sedimentation. This also facilitates the blocking off of one channel for cleaning or maintenance without stopping production.

The relatively shallow depth of the channel or channels 10 will allow for passive degassing by the counter-directional flow of dry nitrogen above the melt.

Furthermore, as the system has no moving parts, requires zero human intervention, and all the processes are 'passive' i.e. occur naturally without intervention the efficiency and implementation of the apparatus is significantly improved with regard to conventional apparatus.

Typically the liquid metal and/or metal alloy is kept molten by overhead electrical elements 24 which extend along the length of the channel or channels 10. The temperature is designed to be low from the heating assembly 2 and through the transfer assembly 26 to maximise sedimentation and degassing efficiencies, reduce energy consumption, and extend refractory life.

Filters 22 can be introduced as required to filter materials from the metal and/or metal alloy prior to the same reaching the mould filling assembly 12.

The mould filling assembly 12 includes a pump 28 and the liquid metal and/or metal alloy is introduced via the opening of a valve in the base 9 ppof the pump body. The body is then pressurised to raise the metal up the riser tube 30 and into the mould. A non-return system keeps the melt at the top of the riser tube 30 ready for the next mould (avoiding falling back to avoid the generation of oxides in the riser tube).

In one embodiment the volume of the body 32 of the pump 28 is approximately only 1 percent of the volume of a low pressure furnace, so that very little pressurising gas is required to operate the pump. Oxidation inside the pump can therefore be avoided relatively economically by the use of the completely inert argon gas. The casting pressures are typically only in the region of 0.2-0.4 bar providing a further economy in the use of argon. Fill time can be programmed to suit.

The small pump chamber or cavity 34 also means that the pump is responsive so a 'fill profile' can be generated for castings if necessary. Combined with modelling flow software it would be possible to know when to speed up or to slow down the rate of fill to reduce the generation of oxides for castings with complex internal geometry which is a significant improvement.

Typically, in this embodiment, a pump of 20-30 kg capacity is suspended in a crucible furnace 36 of a required capacity, such as in the range 300-500 kg aluminium. Electrical resistance heating elements surrounding the crucible permit the raising of the metal temperature to an appropriate casting temperature just prior to casting.

The ability to slide the filled mould casting as will be subsequently described, off the riser tube 30 in, for example the direction of arrow 38 and along the casting platen 40 onto an adjacent support surface has major advantages over current systems and the sliding action allows the cast metal in the mould cavity to start the cooling process 'off-line' and frees up the riser tube 30 within only a few seconds for the next casting mould to be placed over the same.

The casting platen 40 is typically formed of steel and is the surface on which moulds are cast and is flush with the top of the riser tube and the pump 28 is suspended from the platen. Below the casting platen 40 there is provided a production system which can be arranged to provide ultra-clean liquid metal and/or metal alloy and deliver it into moulds in a controlled and repeatable flow avoiding damage to the liquid.

Above the casting platen 40 the user is free to adapt the type of mould and mould handling facilities as they require. One such process employs a vacuum assisted investment block moulding technique for very thin wall precision castings that has been adapted to a counter gravity filling process.

Alternatively, a design involving permanent steel dies is possible for the manufacture of automotive wheels and when compared to current systems, increased quality, reduced production costs and higher production rates seem achievable. The current practice is roughly a wheel every 3-4 minutes with a scrap rate varying between 10-18%. With good mechanical handling for the dies above the platen, a reasonable estimation is that a rate of casting a wheel every 1-2 minutes is achievable with practically zero scrap. The use of a carousel for the steel dies could produce a defect and scrap free 25 kg casting every 30-40 seconds.

Furthermore the same apparatus can be used for the filling of sand moulds.

Embodiments of the respective assemblies of the system are now described and it should be appreciated that the assemblies below the casting platen can be used to advantage in combination or independently and in conjunction with further types of assemblies above the casting platen which may be conventionally available.

With respect to the heating assembly 2 then, in operation, when the charge materials which are to be used to form the liquid metal alloy are placed in the heating assembly heating means in the melter heat the charge materials and heating gases which are created pass in the direction of arrow 100 upwardly through the shaft and thereby heat the charge materials as they pass downwardly through the shaft in the direction of arrow 101 to reach the dry hearth 6 which transforms the charge materials into a liquid molten form. The molten material then runs down the slope 103 and into a holding bath 8 with the skin of the charging material which remains after the liquification of the same remaining on the hearth 6. After a period of time, such as for example, an hour or more, the accumulating pile of oxide skins are removed from the hearth 6 and into a dross bin. This is in contrast to common melting procedures which use baths or crucibles which necessarily mix the highly deleterious oxide skins of the charge into the liquid metal. The dry hearth melting technique effectively segregates the major oxide content, the primary oxide skins on the charge from the melt and with the skins moving to dross bin and the molten material progressing in a different direction.

Turning now to the FIGS. 1*a-b* and 5*a-e* the liquid metal and/or metal alloy transfer assembly 26 is illustrated in greater detail. The molten metal alloy moves from the furnace heating assembly 2 into the transfer assembly 26 and moves along channels 10 and preferably at a uniform height so as to avoid any fall of the material and allow the distribution of the molten material to the required locations in the foundry.

The launder transfer system also includes the overhead electrical resistance element heater 24 to maintain the temperature of the molten material and maintain the same in the liquid condition whilst, at the same time, ensuring that the temperature of the same is as low as can be practically allowed, whilst preventing solidification. The reason for keeping the temperature as low as possible is to provide several benefits which are: the improved degassing of the molten material from hydrogen gas, particularly if a dry gas is flowed counter current over its surface and secondly, the precipitation of second phases onto bi-films occurs more efficiently at lower additions of sedimenting elements, thirdly, the extension of refractory life, and fourthly, the saving of energy.

At the oxide sedimentation pump 16 location, a proportion of the bi-films and their suspension in the molten material will detrain and settle out and can be effectively caught by the system at the base vessel 20. However, it is found that the natural rate of settling is relatively low due to the near neutral buoyancy of the bi-films in the molten material. Thus, in order to enhance the rate at which bi-films settle, prior to entering the detrainment station, the molten material is dosed by a continuous wire feed 105 of elements which will promote sedimentation. The wire feed is, in this embodiment, an aluminium based alloy containing one or more elements which form heavy intermetallic compounds and which deposit and grow on bi-films when, as in this embodiment the molten material is a liquid aluminium alloy. The wire can be fed from, for example a similar apparatus as is used to feed welding wire and the wire feed promotes the controlled sedimentation to occur depending on the flow rate of the molten material.

In one embodiment titanium (Ti) can be added to enhance the rate of sedimentation of bifilms from the liquid metal. The elimination of oxide bifilms down to perhaps a size of 10 um is dependent on a number of factors including (i) the cleanness of the charge material: (ii) the melting rate: (iii) the level of alloy additions: (iv) the temperature.

As the dosed molten material enters the oxide sedimentation pump 16 of the launder, the tendency is for the molten material to continue its horizontal flow as indicated by arrow 107 and to traverse the upper level of the sedimentation volume because of the slightly favourable temperature gradient resulting from the overhead heating causing the upper layers of liquid in the launder to be slightly lower density. The horizontal flow distance across the top of the sedimentation volume is targeted to give adequate time for bi-films above a maximum size to settle out of the flow. For instance, a flow time of one minute across the unit might result in the descent of bi-films by at least 100 mm thereby allowing them to escape the horizontal flow stream and reach the largely stagnant liquid below at the vessel 20. This eliminates bi-films of a certain size, corresponding for instance to the elimination of all bi-films down to a 5 micrometres diameter, whereas a 10 minute traverse time would eliminate bi-films down to perhaps 1 micrometre diameter. These elimination dimensions will depend on the concentration of the dosing alloy, the speed of the molten metal across vessel 20, and the temperature of the liquid.

In a continuous flow regime, such as is required for DC casting, a continuous flow through the sedimentation unit could also be subject to the same logic requiring length of time, lowness of temperature and concentration of dopant to effect a useful cleaning action down to an acceptable maximum size of oxide bi-film defect.

Typically, the sedimentation vessel 20 is shaped to concentrate the sediment at a point of maximum concentration and at that point, the sediment is sucked out by a bubble lift or vacuum pump (OSP) 18 shown in more detail in FIGS. 5*a-e*. The molten material enters the OSP assembly 18 at the entry 137 and at which typically the wire 105 is located. The molten material passes into the sedimentation vessel 20 at which tubes 138 conveying inert gas are located to provide gas down into the sedimentation volume at a sufficient rate so as to create intermittent bubbles and preferably forms bubbles at a conveniently high point in a riser tube 140 because bubbles created low down in the riser tube expand as they rise, finally filling the whole tube and continuing to accelerate, lifting the flocculent by means of a vacuum. The result is an exit of sediment in an accelerated manner which is effectively uncontrolled. To better control the lifting action, the bubble tubes 138 are gradually lowered into place so that controlled, trauma free movement of the sediment from the molten material in the sedimentation volume is achieved.

The bubbles from the exit 139 of the tubes 138 then rise up the respective coaxial outer riser tubes 140 and as they do so the bubbles act as a piston so as to move the contents of the riser tubes 140 with the flow of the bubbles in the direction of arrows 141 to the exit 142 and into dross bins 144. Once primed, each bubble will lift up what is in the tube above it and suck in more oxides and sediment from the bottom of the sediment vessel 20. Typically the shape of the exit 142 will be chamfered and has the effect of pushing the oxides and sediment clear from the exit and therefore allows the same to be clear for the next bubble and entrained sediment.

Typically the larger the gap between the respective inner tube 138 and outer riser tube 140, then the greater amount of sediment which can be removed by each bubble from the molten material.

The bubble generation rate and/or frequency and the provision of specific types of wire feed can be electronically linked to the required flow rate of the molten material as dictated by, for example, the furnace and/or required casting rate. Typically the higher the flow rate then the more additions of wire material and removal of sedimentation is required.

Also, the inner diameter of the riser tube may be increased to counter the effect of a bubble, or agglomeration or bubbles, ejecting liquid and sediment from the exit 142. The lifting action of the bubbles to provide a discreet pulsing action therefore assists the flow of the flocculant volume of sediment. The gas involved is required to be an inert gas such as argon.

Alternatively, instead of a tube with an exit 142 from which bubbles are released with the sediment, a porous plug is provided in the base of the sedimentation vessel 20 and the riser tube 140 is adjustable so as catch the bubbles emerging from the porous plug.

Alternatively to the provision of dross bins, it may be advantageous to cast the sediment into ingots near the top of the riser tube and so that instead of dross bins, ingot moulds are provided to be filled, and then the ingots can be moved away and stacked and this can, in one embodiment be performed in an automated manner. In this embodiment, then in place of an overflowing chute to carry away the sediment from the top of the riser tube, the riser tube connects directly with an ingot mould, causing sediment to fill the mould in a counter gravity manner and when the mould is filled, the mould and its solidifying sediment is moved away to be replaced by a new mould and so on. In one embodiment, the mould can be handled and emptied by a robot which may also perform the stacking operation and therefore not require any human intervention.

In an alternative example of the apparatus in accordance with the invention instead of the use of a bubble lift to extract sediment, a vacuum lift is used which has the advantage of increased control, avoiding the possible instability caused by the uncontrolled expansion of the bubble during its rise. The vacuum lift once again has the benefit of few moving parts. It can also be connected to an ingot casting station, in which newly formed ingots of sediment are cast, and can be transported away and stacked by robot.

In one embodiment, the sedimentation collection process can be used in series to further perform a cleaning effect on the molten material in stages. Although this embodiment might suggest that the same benefit could be gained by enlarging the sedimentation pump, effectively lengthening the distance which the liquid metal flows over the top of the sedimentation volume and so lengthening the time available for sedimentation, such an embodiment is not recommended in at least certain instances. This can be because the sediment requires walls at some angle of repose in the region of 45 degrees, thereby necessarily forming a sedimentation volume deeper than approximately 0.5 metre. Most furnaces containing liquid aluminium are limited to approximately this depth because of the danger of leakage. With increasing depth beyond 0.5 metre, it is widely accepted that the danger of leakage becomes unacceptable.

After the molten material has traversed the sedimentation stage 16 on the transfer assembly it is necessary to ensure that the metal does not suffer any further entrainment affect whereby fresh bi-films would be created.

Thus it is ensured that after the liquid metal has traversed the sedimentation pump 18, the metal is never poured, but continues its horizontal flow along channels 10, to the mould filling assembly and then finally transported counter-gravity into the moulds as will be described to manufacture cast products.

Referring now to FIGS. 2*a-e* and 3, there is illustrated in a schematic manner a mould filling assembly 12 in accordance with one embodiment of the invention and the apparatus includes a supply of liquid metal 104, such as a holding furnace 36 which retains the metal at a sufficient temperature so as to be held in a liquid state. A pressurised means such as a pump 28 allows the liquid metal to be supplied to a riser tube 30 in the liquid state and to pass upwardly in the direction of arrow 110 through the riser tube. The riser tube has an outlet or orifice interface 112 which is provided for the selective location with an ingate 114 of a mould 116 which has a cavity 118 which is to be filled with the liquid metal and/or metal alloy.

The apparatus further includes a support surface in the form of the casting platen 40 and the surface may be formed of a relatively "cool" material such as steel which is sufficiently hardwearing to withstand the sliding action of the moulds 116 thereacross. In one embodiment, the surface of the casting platen 40 are acted upon by a cooling medium applied to its underside which is supplied from a cooling medium source, such as cool water or air so as to assist in maintaining the said support surfaces 40 in a relatively cool low temperature condition.

Figure 2:
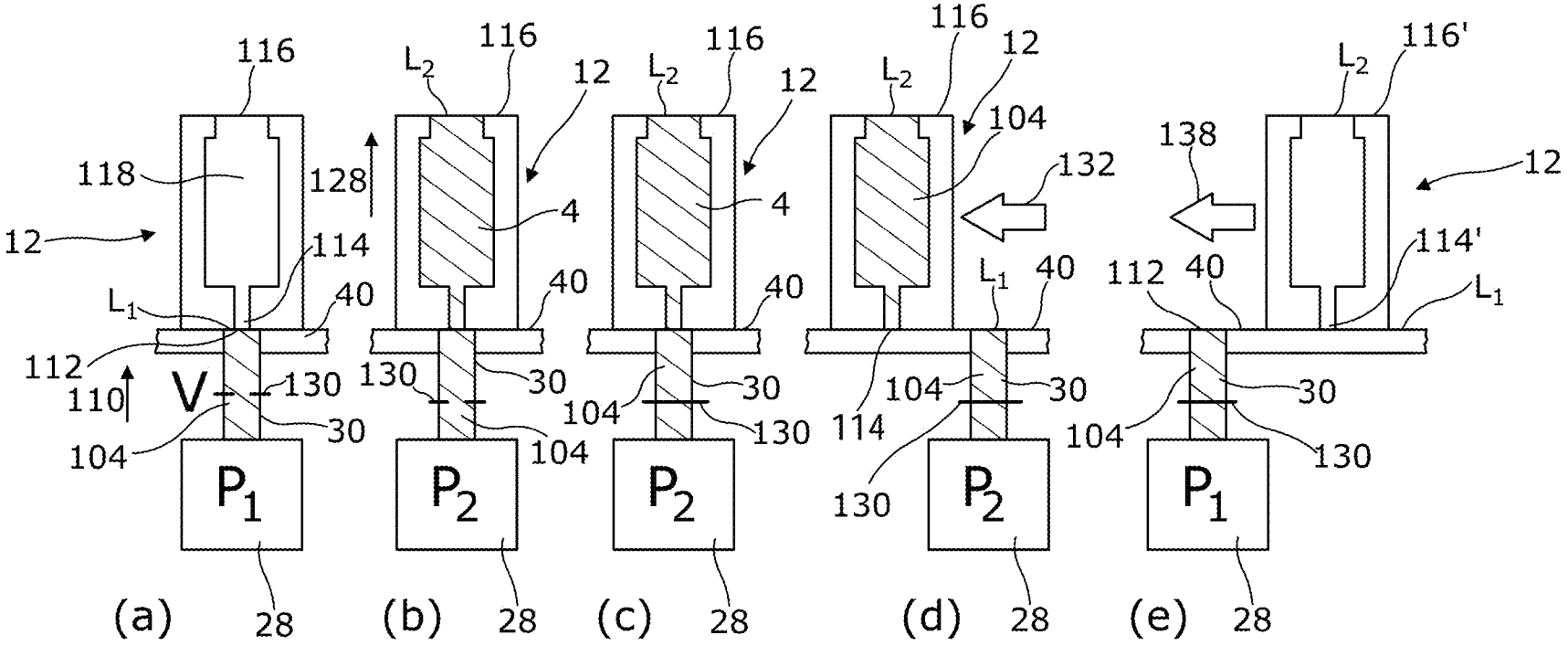
FIGS. 2*a-e* illustrate an apparatus in accordance with one embodiment of the invention prior to the commencement of use of the same.
Figure 3:
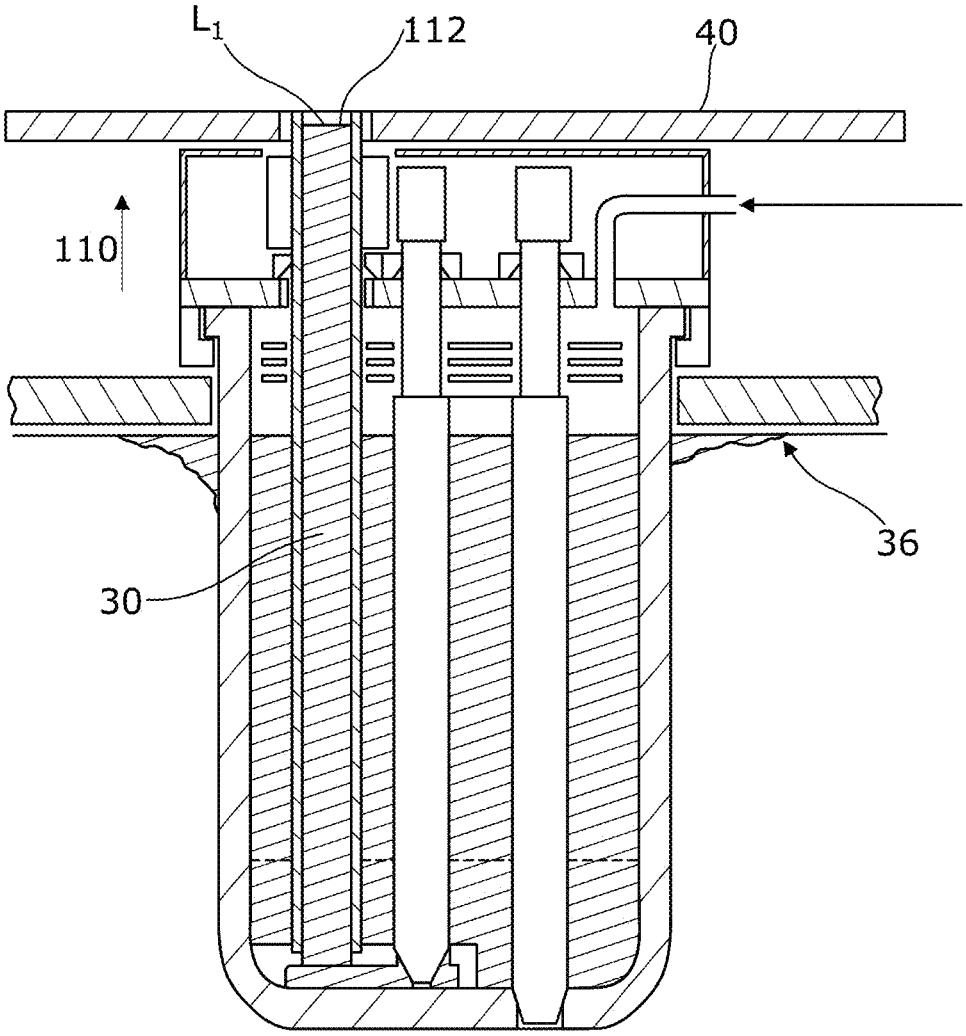
FIG. 3 illustrates the apparatus components in accordance with one embodiment of the invention.

FIG. 2*a* illustrates the mould 116 having been placed in position on the casting platen with its ingate 114 aligned with the riser tube 30 and in connection with a gasket seal which can be formed of a compressible ceramic fibre and held in place, if necessary, by being partially recessed into the mould so that the ingate 114 of the mould 116 is connected to the orifice interface 112 of the riser tube 30 as shown. The liquid metal 104 is pressurised to a pressure P1 by the pump 28 which is just enough to provide the liquid metal 104 at a level L1 which is substantially level with the support surface 40 or a few millimetres below the same.

The condition of the pump 28 is then changed to increase the pressure of the liquid metal 104 to P2 which causes the level of the liquid metal to rise upwardly as indicated by arrow 128 to level L2 as shown in FIG. 2*b* so that the liquid metal 104 fills the cavity 118 of the mould. When the mould cavity is filled a valve 130 which until this point has been open, is closed so retaining the liquid metal 104 at height L2 and isolating the mould 116 from the pump 28.

As the mould 116 cavity 118 is now full of liquid metal 104 and is now isolated from the pump 28 and is in the condition shown in FIG. 2*c*, the mould 116 can then be slid sideways as indicated by the arrow 132 in FIG. 2*d*, so as to remove the ingate 114 from the orifice interface 112 of the riser tube 30 and the ingate 114 is maintained in contact with the support surface 40) as the sliding movement occurs. Any imperfections in the base of the mould can be accommodated and mitigated by the provision of the ceramic fibre gasket around the mould ingate 114, which acts to seal the sliding interface. Also, no liquid metal spurts from the open orifice of the riser tube 30 as the level of the liquid metal 104 in the riser tube 30 remains at L1 and cannot rise while the valve 130 remains closed. During the closure of the valve 130 the pump 28 may be recharged with liquid metal 104 from the holding furnace 36.

The mould 116 is then continued to be slid in the direction of arrow 132 until the mould 116 reaches a position which is sufficiently remote or removed from the orifice 112 so that the orifice is then free and can be subsequently reused by the placement of a new mould 116' which is slid into position as indicated by arrow 138 as shown in FIG. 2*e* so as to bring the ingate 114' into connection with the riser tube 30 and the cycle of steps is repeated to fill that mould 116' and so on with successive moulds.

Figure 4:
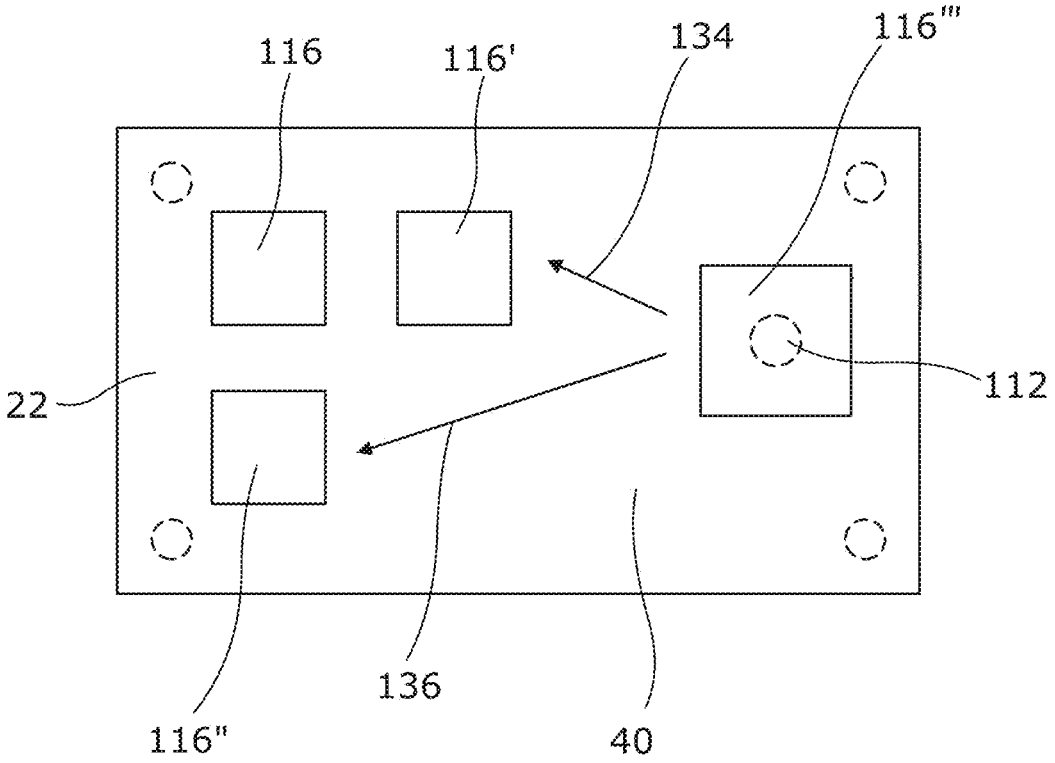
FIG. 4 illustrates the apparatus in accordance with one embodiment in plan and subsequent to the filling of a first mould and in-use to fill a second mould.
Figure 5A:
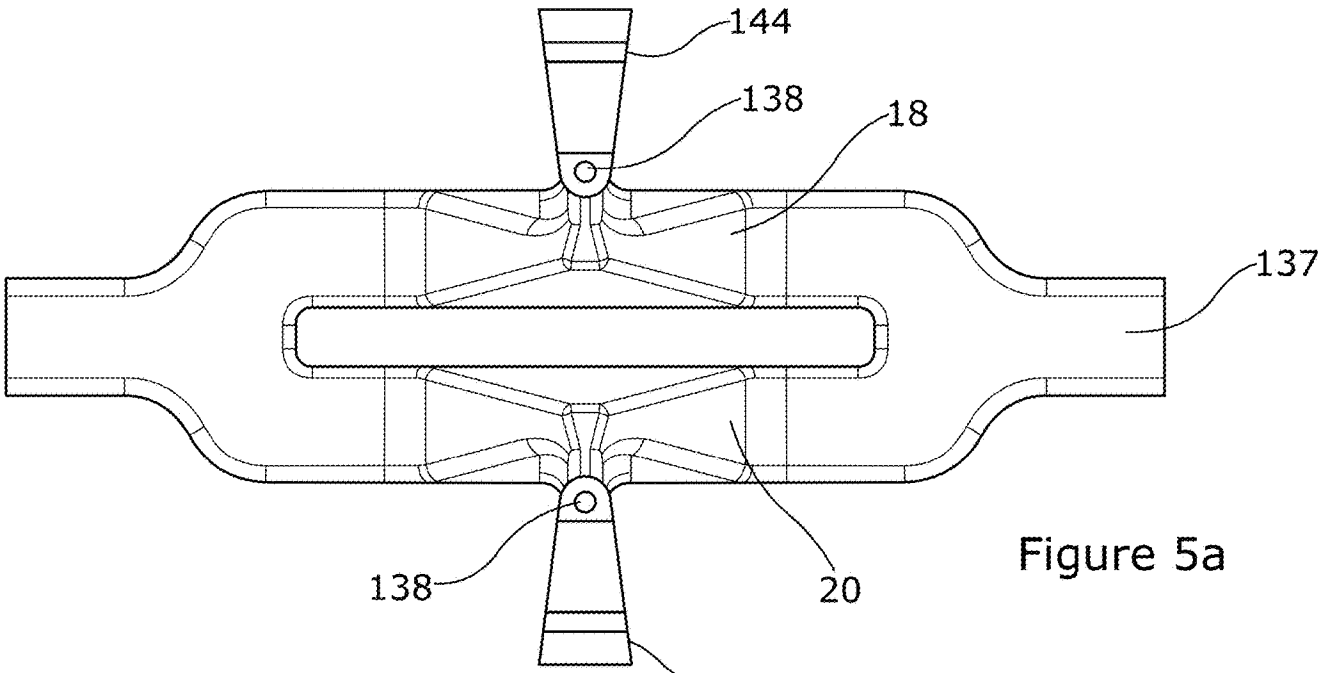
FIGS. 5*a-e* illustrate one embodiment of the transfer assembly in accordance with the invention.
Figure 5B:
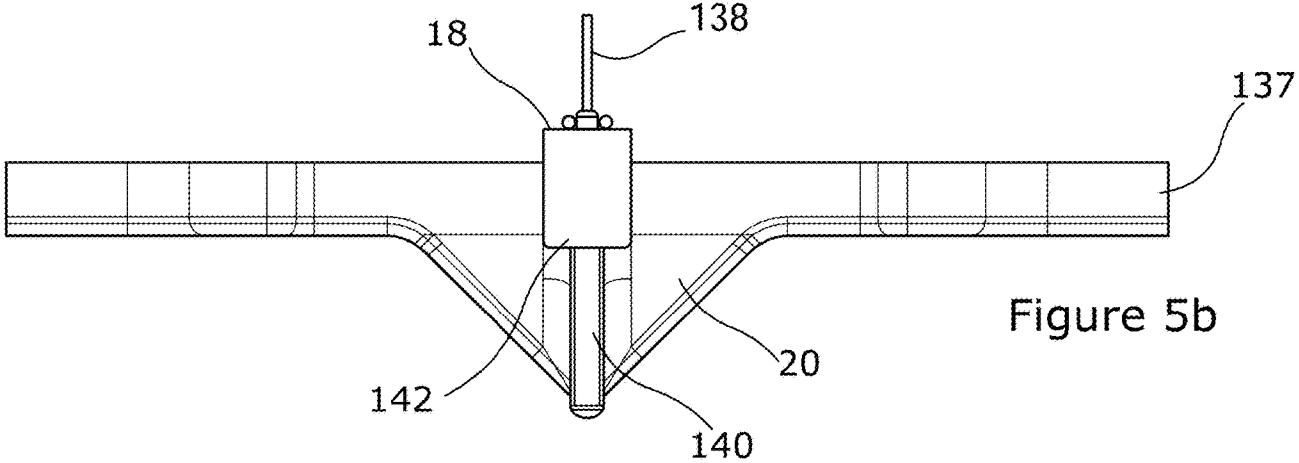
Figure 5E:
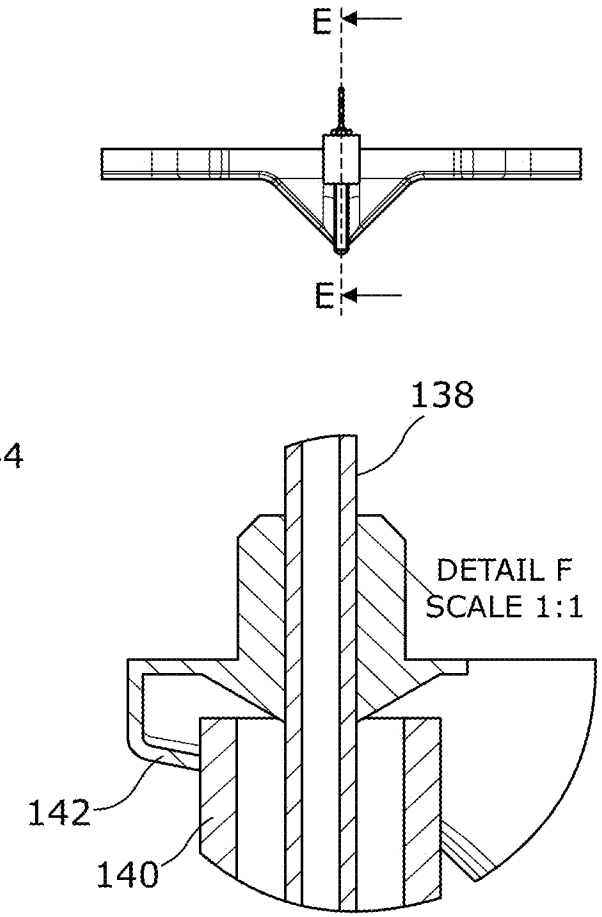
Figure 5D:
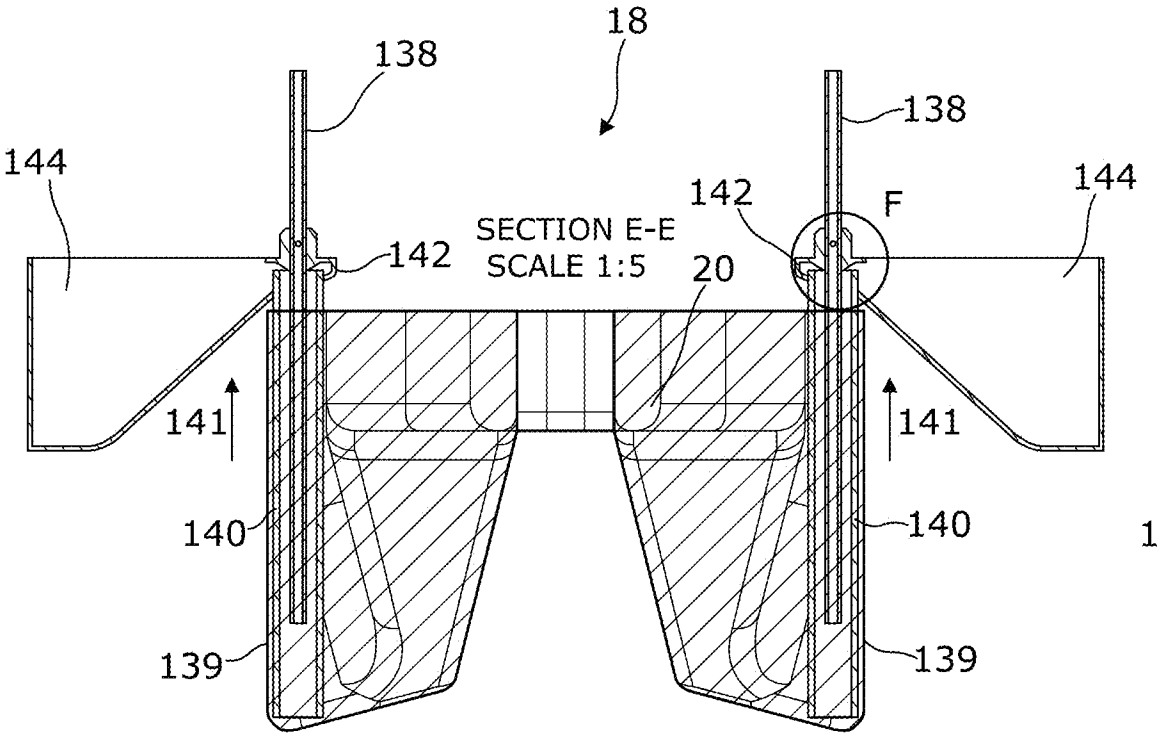
Figure 5C:
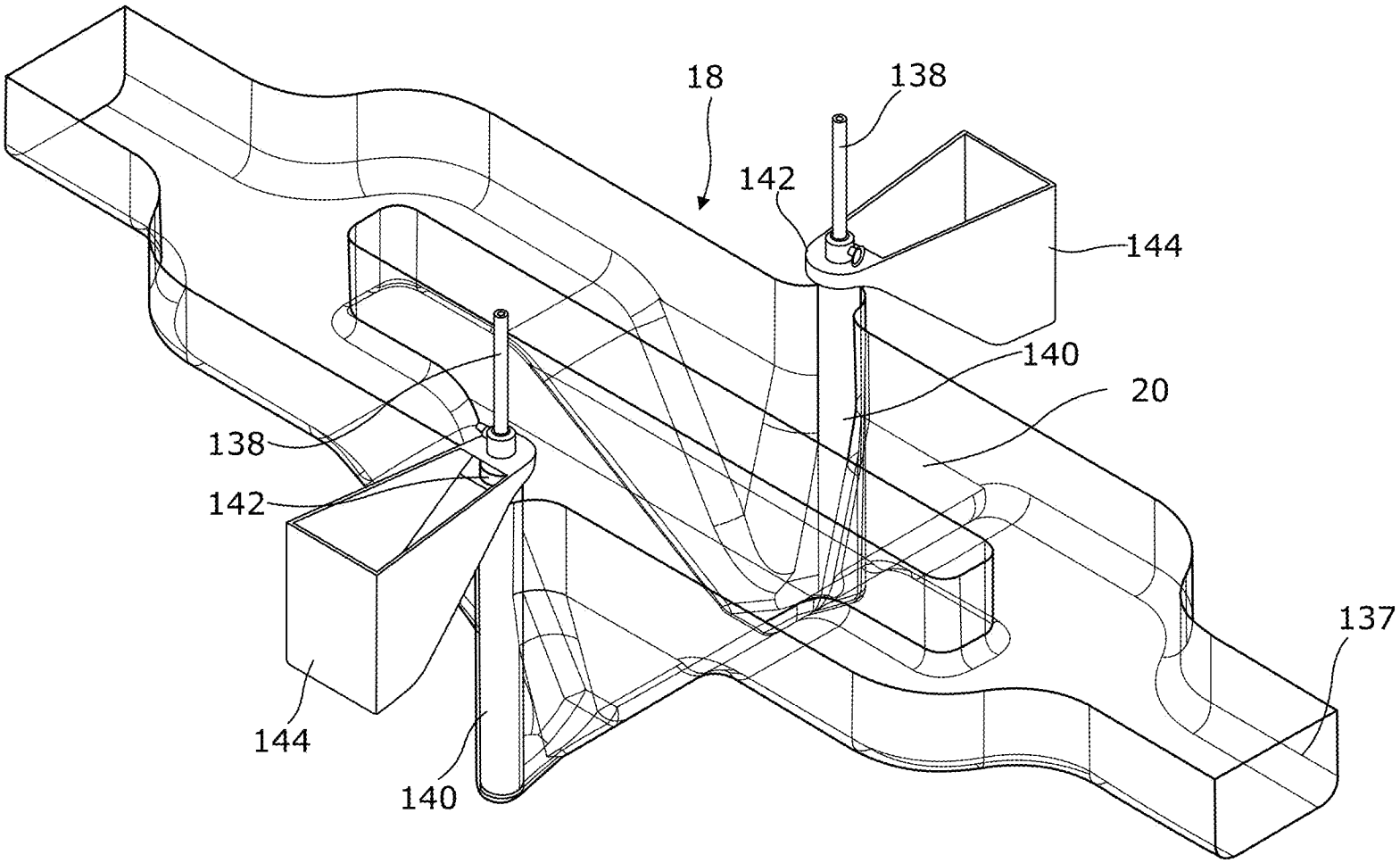

FIG. 4 illustrates a plan view of the casting platen 40 which has located thereon the mould 116 which has been filled as described with regard to FIGS. 2*a-e* so that this first mould 116 can be retained in position on the surface 40 for as long a period of time as required so that the cooling effect of the casting platen 40 solidifies the liquid metal 104 in the cavity 118 to a sufficient extent so that the first mould 116 can subsequently be removed from the casting platen 40 without any risk of loss of metal which may cause damage to the casting therein or harm to personnel. While this mould 116 is cooling, the ingates 114' of subsequent mould 116' and then ingate of mould 116" have been connected, in sequence, to the orifice interface 112 of the riser tube and the liquid metal 104 introduced into the same using the method as described and without delay as the orifice 112 and surrounding casting platen 40 is quickly cleared for use. As the process steps are repeated for successive moulds, the moulds 116', and 116" are shown as having also been slid as indicated by arrows 134 and 136 respectively to locations on the casting platen 40 and a fourth mould 116''' is shown in connection with the orifice interface 112 and is in the process of being filled.

It will therefore be appreciated that at any given time, there may be one, two or further moulds all cooling on the casting platen 40 while subsequent moulds are being filled. As a result, the productivity time using this process, is significantly improved so that for example, with minimal moving parts, and minimal loss of liquid metal and costs, a typical cycle time for a 1-2 kg mould casting is estimated to comprise:

5 seconds for the siting of the mould over the riser tube
5 seconds for the filling of the mould
5 seconds for the actuating slide and pressure reduction and opening of valve V So that a total of 15 seconds is the estimated cycle time. For castings which are larger, typically up to approximately 200 kg, the filling time would be increased but only extending the cycle time to perhaps 30-40 seconds.

Turning now to FIGS. 6*a*-8*f* there are illustrated components utilised in the mould filling assembly 12 which are now described in detail.

In the pump 28 illustrated in FIGS. 6*a*-*h* there is shown a pump body 32 which may be of height which is selected to suit the desired capacity of the particular pump. In addition, the length of the riser tube 30 and valves 44, 46 need to be provided of a length to match that of the selected pump body 32 and all of the other components of the pump 28 can be common and regardless of the particular capacity of the pump. Filter 48 is bonded to an insert 50 of the pump and the filter 48 prevents ingress of oxides into the pump body 32 and the filter 52 protects the valves 44, 46 from oxide debris and prevent the same from settling on the valve seats. A baffle box 55 is located in the body 32 by pins from the interior of the pump body in order to minimise any leaks to externally of the pump and the working melt level of the liquid metal and/or metal alloy is 10 mm lower than face 56 of the baffle.

Figure 6B:
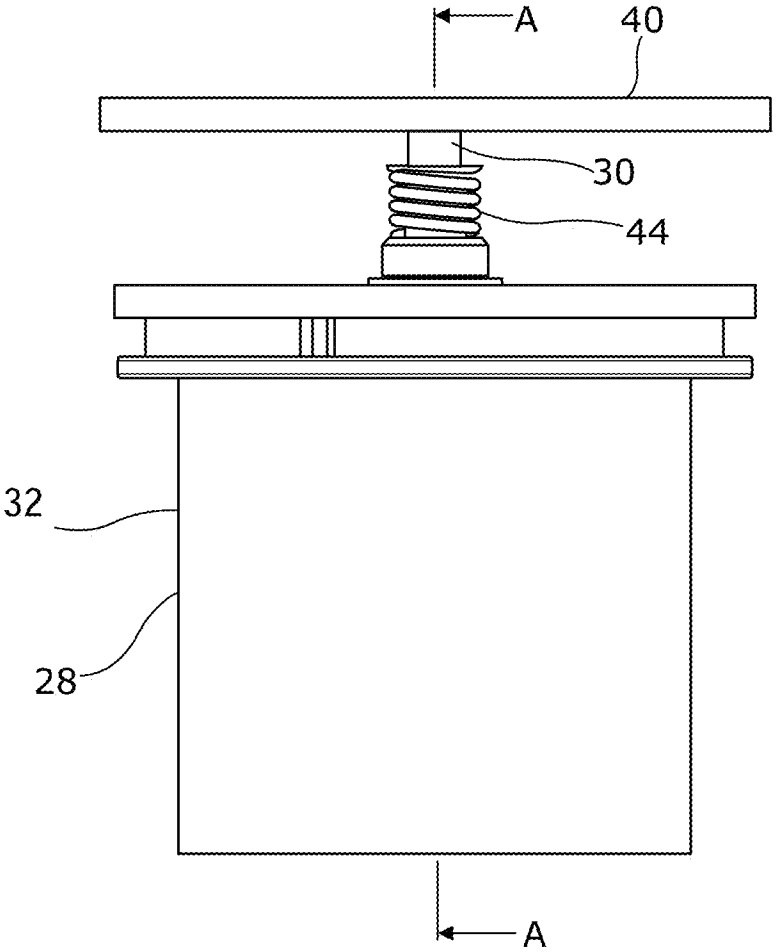
FIGS. 6*a-h* illustrate views of one embodiment of the pump of the mould filling assembly.
Figure 6A:
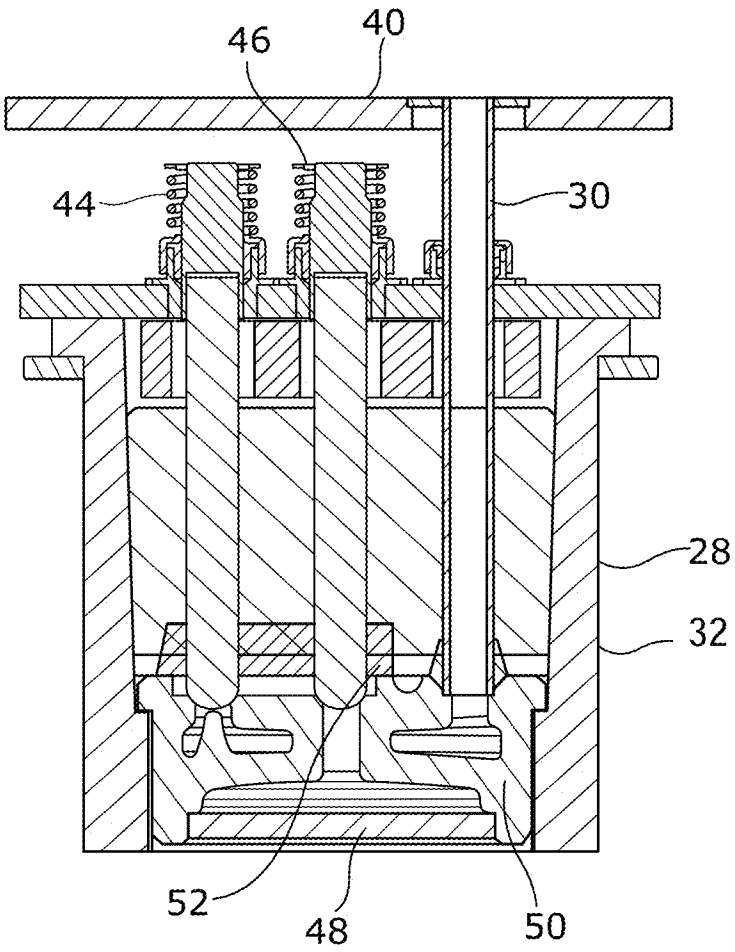
Figure 6D:
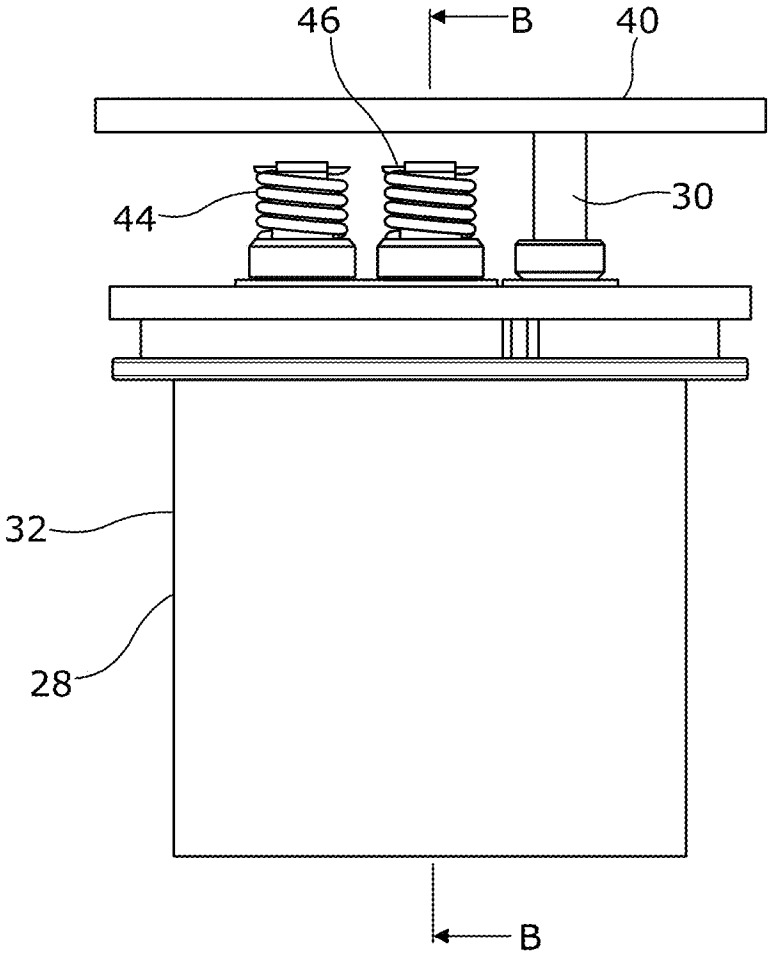
Figure 6C:
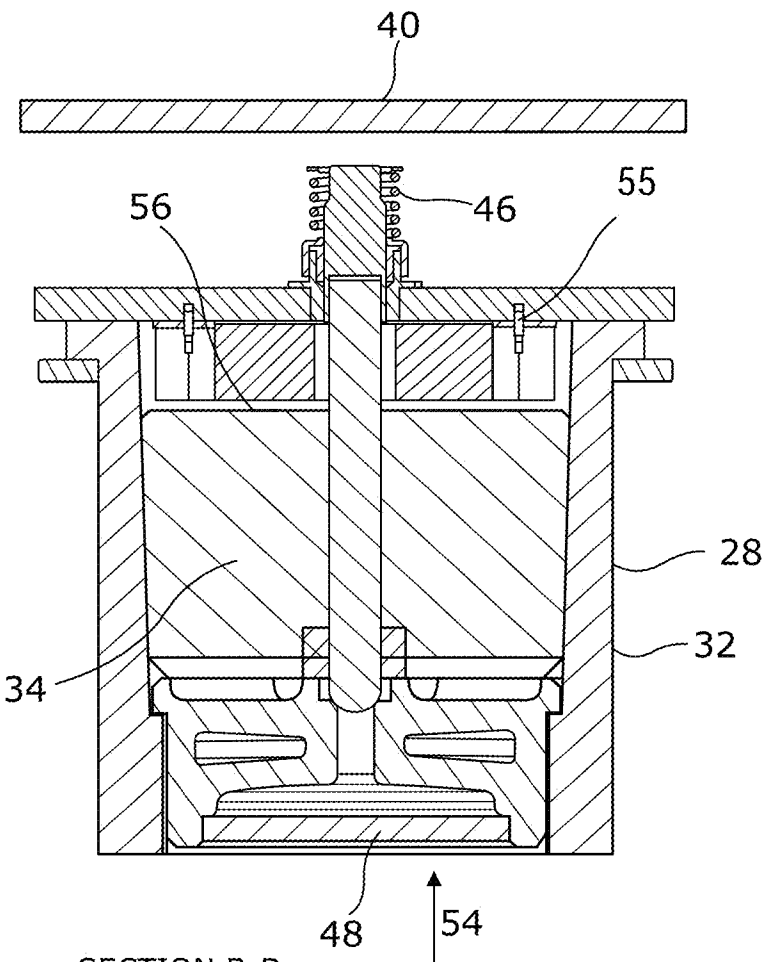
Figure 6F:
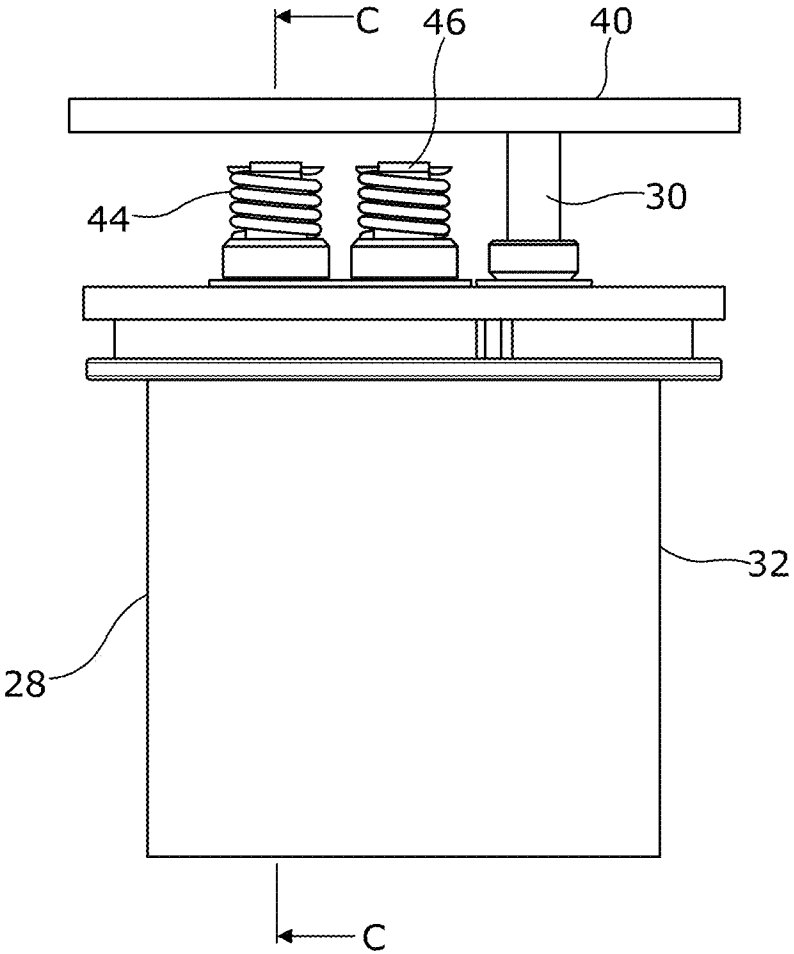
Figure 6E:
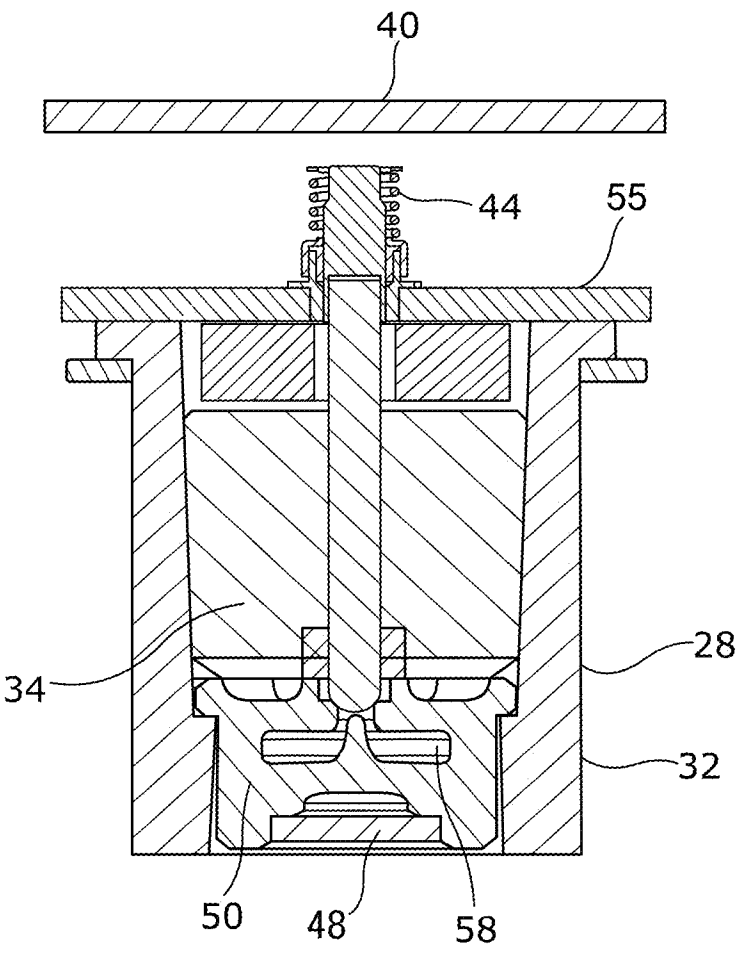
Figure 6H:
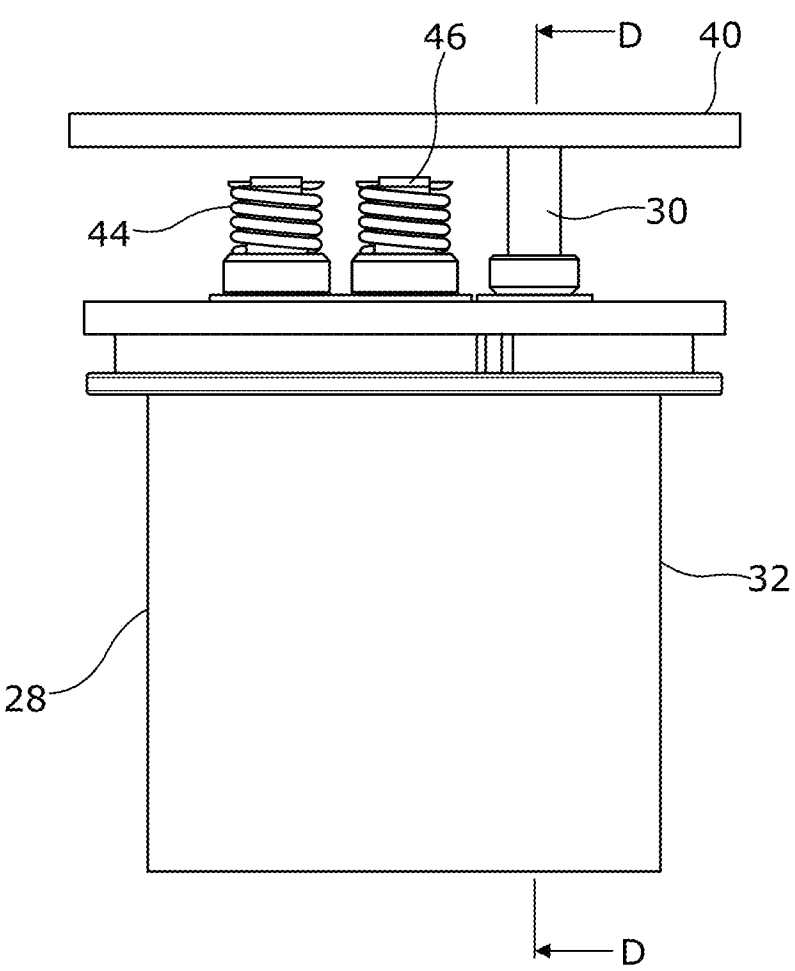
Figure 6G:
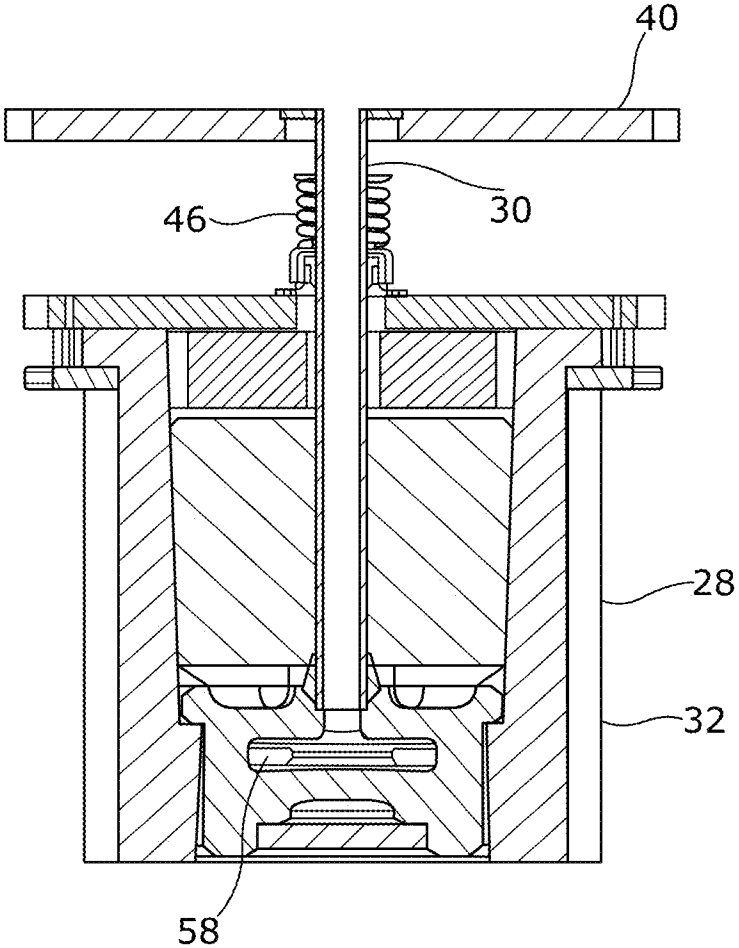
Figure 7C:
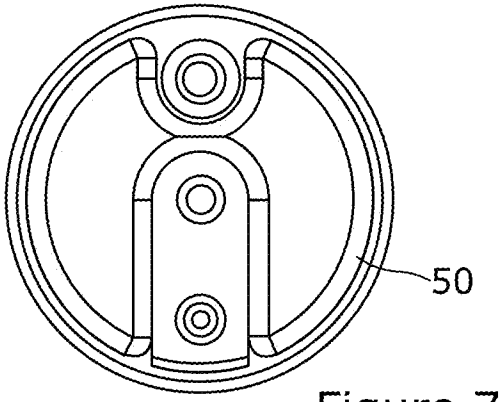
FIGS. 7*a-g* illustrate views of a replaceable insert for the pump of FIGS. 6*a-h*.
Figure 7B:
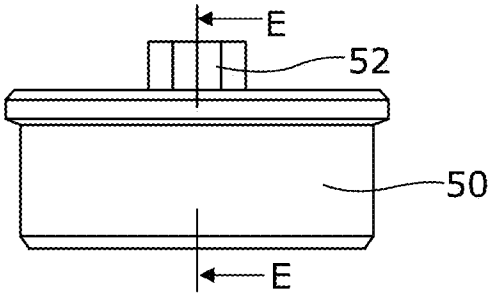
Figure 7A:
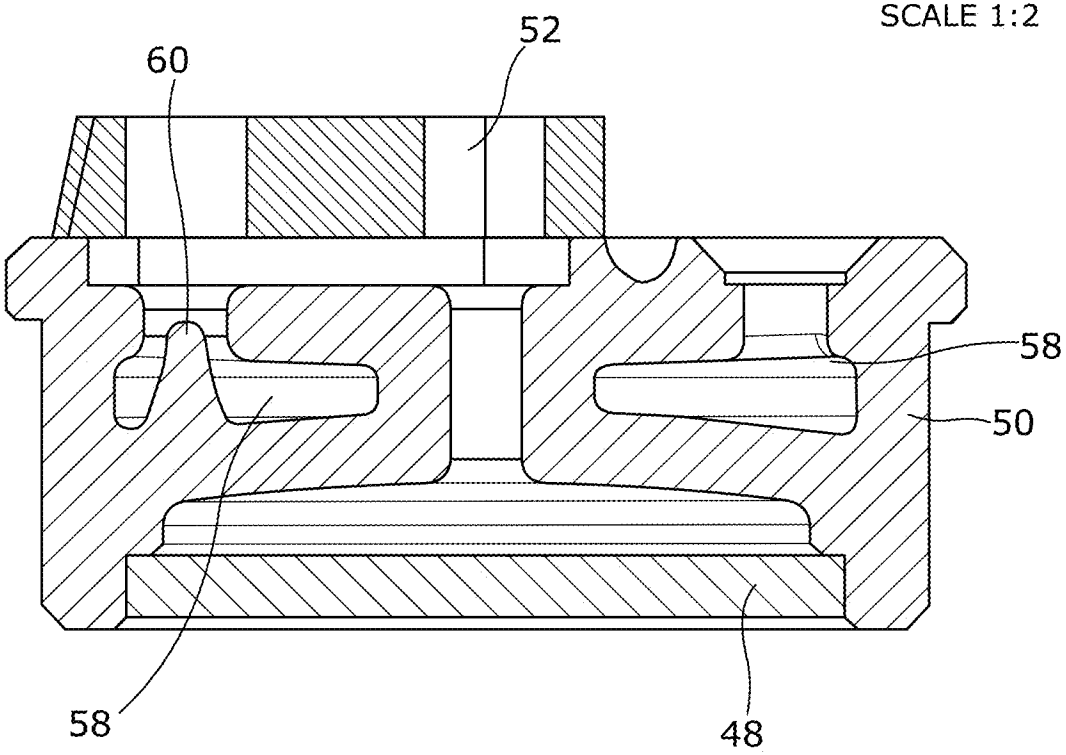
Figure 7E:
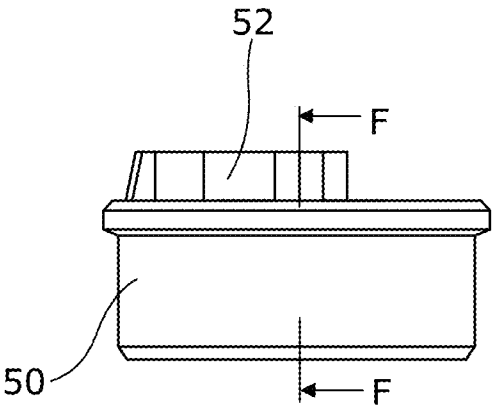
Figure 7D:
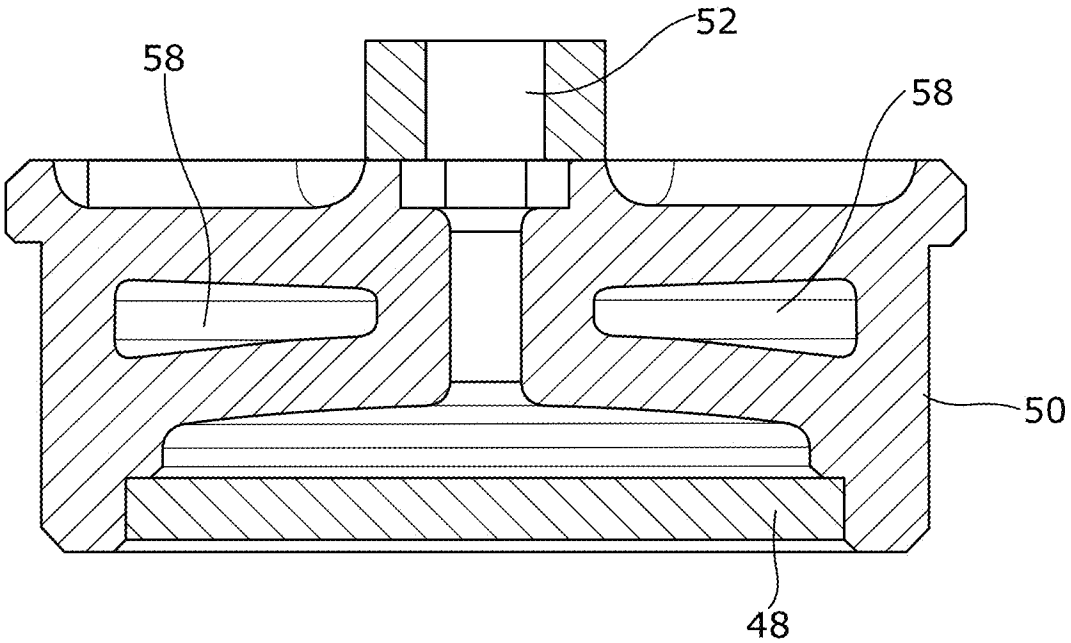
Figure 7F:
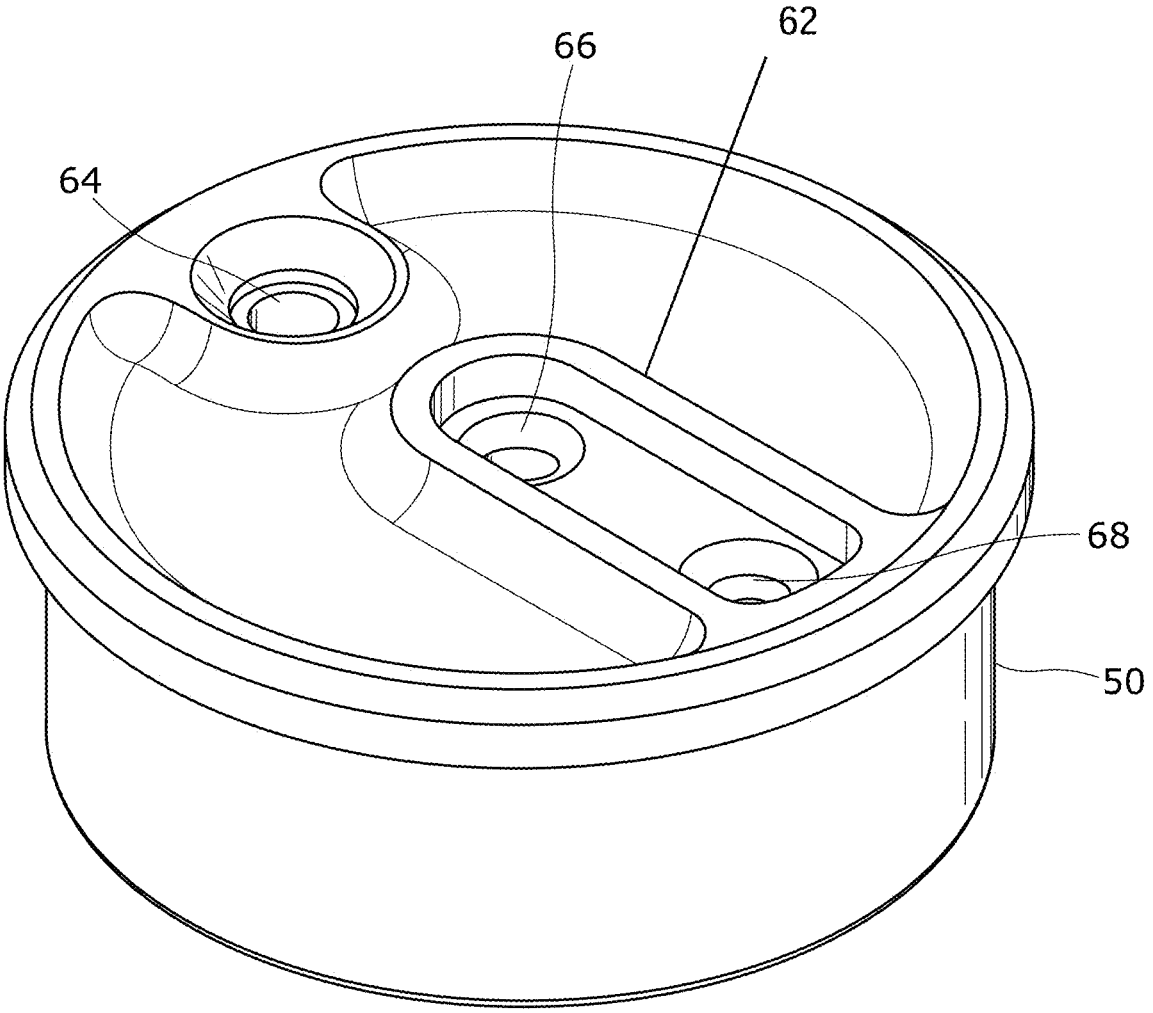
Figure 7G:
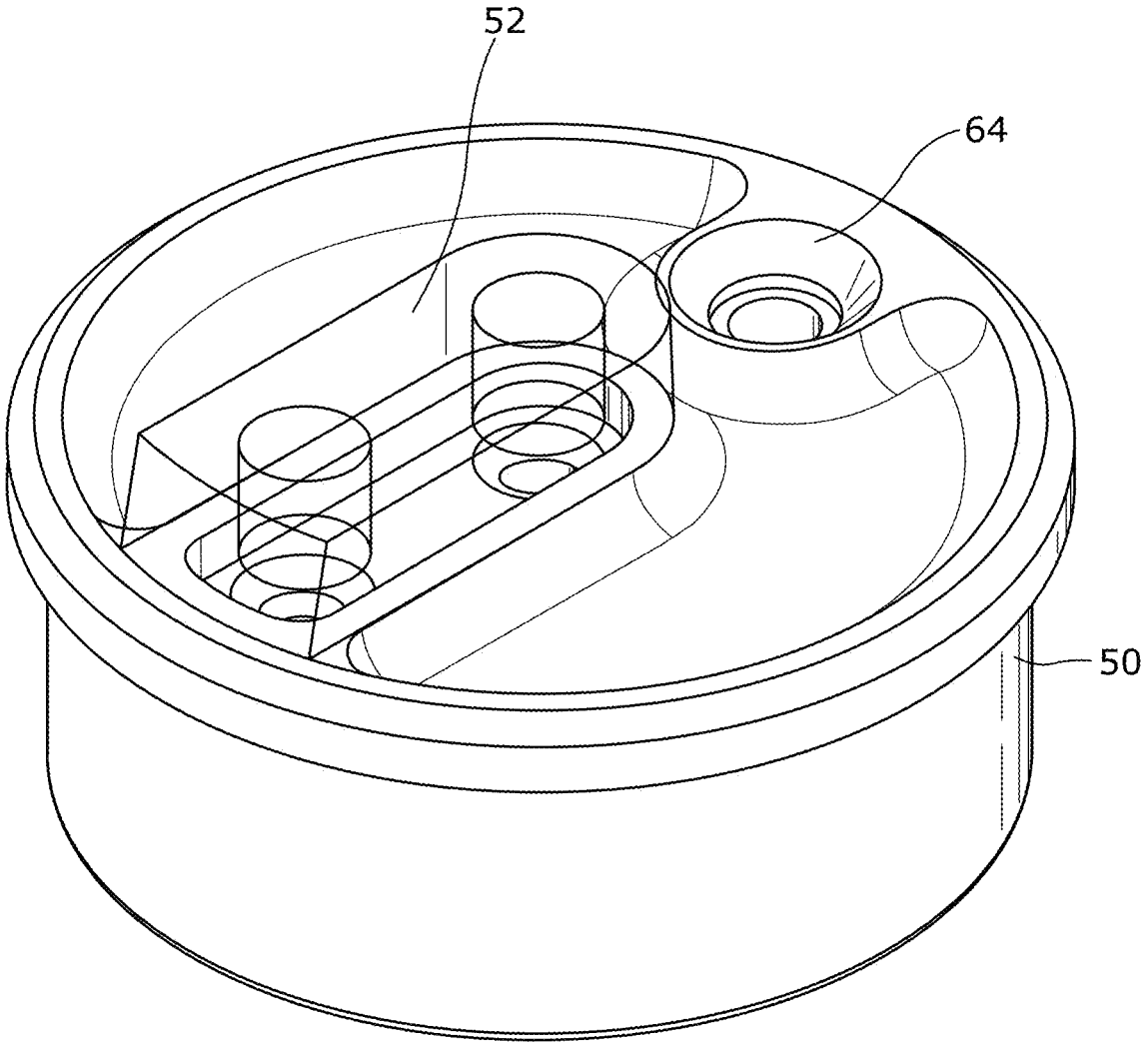
Figure 8C:
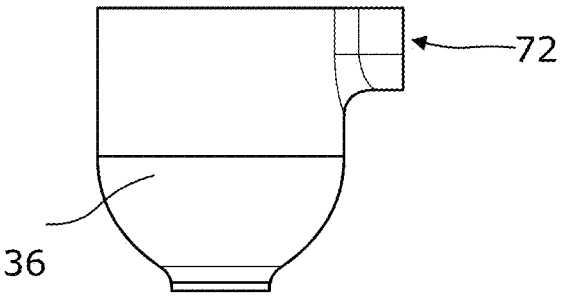
FIGS. 8*a-f* illustrate a component for use with the furnace of the mould filling assembly in accordance with one embodiment of the invention.
Figure 8D:
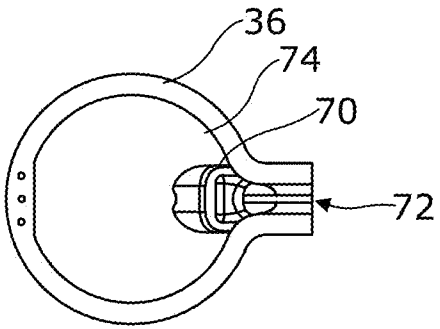
Figure 8B:
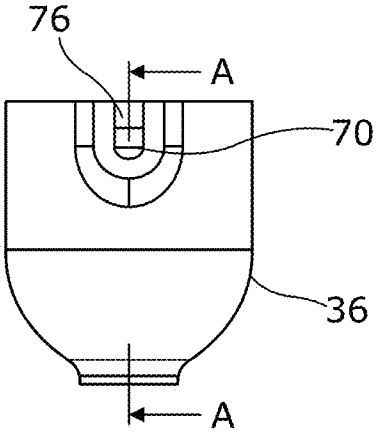
Figure 8E:
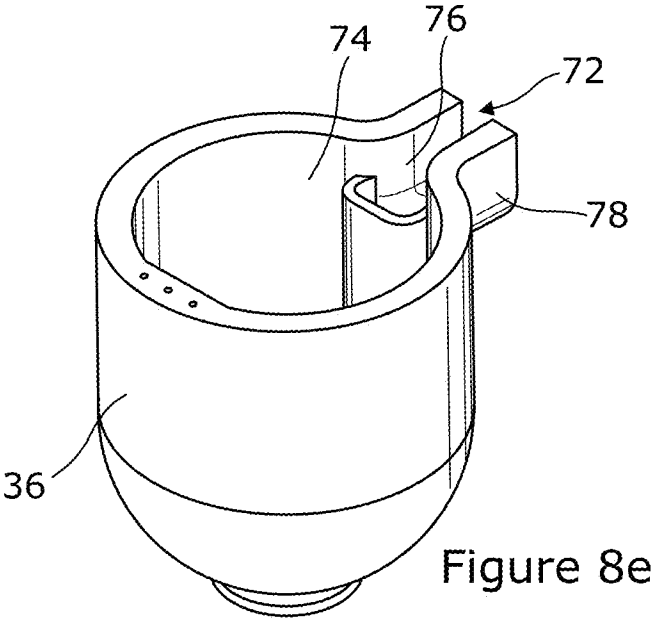
Figure 8A:
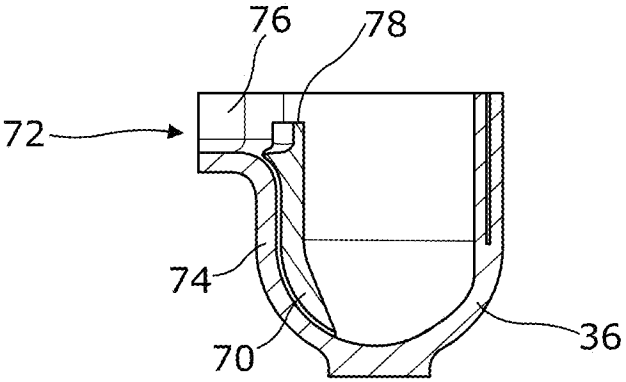
Figure 8F:
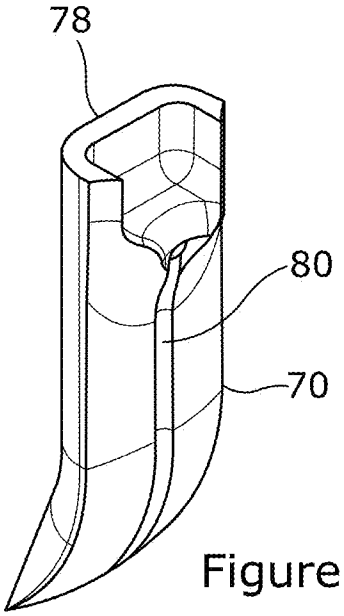

When the pump is out of use or requires cleaning the insert 50 can be removed and if necessary replaced by moving the same as indicated by arrow 54 in FIG. 6*c* into the main cavity 34 of the pump body, typically using a hydraulic press. The insert includes a tunnel 58 therein which, in this embodiment is toroidal in shape, and allows the flow of the liquid metal from the main cavity 34, through the tunnel and into the riser tube 30 from where the liquid metal and/or metal alloy move upwardly towards the casting platen 40 and the mould located thereon to thereby flow into the mould cavity to fill the same.

The tunnel and the components of the insert are shown in greater detail in FIGS. 7*a*-*g* and it will be seen that the tunnel includes a tapered post 60 to allow the liquid metal and/or metal alloy to enter the tunnel with reduced turbulence.

The tunnel 58 floor can have upon it a textured surface, this textured surface is designed to snag and hold any bi-films that have entered the pump.

The riser tube 30 lower end has a filter directly below it, such that any metal that wants to pass into the riser tube 30 from the tunnel 58, has to go through the filter. This is to trap and snag any bi-films that have made it this far into the pump.

The upper face 62 of the insert includes the interface 64 with the riser tube 30 lower end and the interfaces 66,68 with the respective in valve 46 and out valve 44 of the pump.

In FIGS. 8*a*-*f* there is illustrated a component for use with the furnace 36 of the mould filling assembly, and into which furnace the liquid metal or metal enters from the channel 10 of the transfer assembly 26 in the direction of arrow 72. In accordance with this embodiment the component 70 is elongate and is formed of a refractory material and is attached to the inner wall 74 of the furnace 36 adjacent the entrance 76. The component has a lip or wall 78 which is located above the height of the base of the entrance 76 and hence prevents overflow of the liquid metal and/or metal alloy into the crucible 36 before the level of the liquid metal and/or metal alloy in the crucible reaches the height of the base of the channel 10 and hence reduces the possibility of the generation of oxides in the liquid metal and/or metal alloy in the crucible. This therefore encourages the priming of the liquid metal and/or metal alloy in the crucible from the bottom of the furnace 36. The component can also be provided with a pour formation 80) passing to the bottom of the furnace to further direct the flow of the liquid metal and/or metal alloy. Furthermore, the component can be left in place, as even once the priming from the bottom of the furnace has been achieved and the furnace is full and overflows the melt level would be the same height and so there would be no drop-off of the liquid metal and/or metal alloy on the other side. It is also envisaged that the melt rate of the dry hearth melter assembly 2 can be controlled to match the hole in the component 70.

It should also be appreciated that the size and capacity of the pump 28 which is used can be altered to suit the size of castings required. For example, if the castings are typically 3 kg, the melt rate 200 kg/h, a 20 kg pump can be used which has the potential to deliver about 1000 kg/h. However alternatively a larger pump, for example, with a 40 kg capacity can be used which would yield for instance 20 kg castings filled in approximately 10 seconds, giving approximately 100 castings/h, requiring a melt rate of 2000 kg/h. The size of the pump can be increased to 200 kg shot size. However, of course, for such large castings, the numbers of such castings per day is usually limited.

The apparatus and method as herein described provides an optimum casting package for most mould types, providing superior casting quality and the reliability of a system with few moving parts, low energy consumption, efficient use of metal and low-cost replaceable consumables.

The system requires a minimal labour input beyond an operator in charge of melting and periodic primary oxide removal, and an operator to monitor the oxide pump and casting station whilst at the same time reducing the conventional scrap rate of between 10-18% to near zero with oxide-depleted metal and controlled, non-turbulent filling, for any foundry using this technology.

Furthermore there is a significant potential for improved properties of the cast alloy. A sufficiently high ductility will allow, for the first time, an acceptance of the necessary accompanying loss of some of the ductility by the addition of higher levels of alloys to increase strength. A high and reliable ductility (elongation to failure) will allow users of the technology to enter into markets that have traditionally been a no-go area for castings. The cast material which is created as a result of use of the system, is expected to have a high thermal and electrical conductivity as a result of the absence of bifilms. The bifilm populations generally present in cast Al alloys, acting as a population of cracks, cause the heat to travel via circuitous, lengthy routes, because it cannot cross the 'air gap' of the cracks. In contrast, of course, in ultra-clean metal, heat or electrons will flow efficiently in straight lines, offering minimal resistance to flow.

The invention claimed is:

1. Apparatus for use in casting of metal or metal alloy, said apparatus comprising:

a heating assembly in which the metal or metal alloy is changed into a liquid state;

a mould filling assembly in which the metal or metal alloy is moved into a mould to be cast; and a transfer assembly to transfer a liquid metal or metal alloy to flow between the heating assembly and the mould filling assembly, and the transfer assembly includes substantially along its length, one or more overhead heating means configured to maintain a temperature and liquid condition of the metal or metal alloy as it moves along the transfer assembly; whilst ensuring that the temperature prevents solidification, a means to introduce dry gas over a surface of the liquid metal or metal alloy counter current to flow of the liquid metal or metal alloy to passively degas the metal or metal alloy during passage of the said metal or metal alloy through the transfer assembly and a launder with a surface on which bi-film sediment separated from the liquid metal or metal alloy collects and from which the bi-film sediment is extracted from the transfer assembly, and wherein the transfer assembly includes dosage means to allow a dosage into the liquid metal or metal alloy of one or more heavy metal elements as it passes along the transfer assembly to promote sedimentation of the bi-film sediment from the liquid metal or metal alloy.

2. Apparatus according to claim 1 wherein the heating assembly is provided in a form of a dry hearth melter from which the liquid metal or metal alloy is transferred in a molten liquid condition via the transfer assembly to the mould filling assembly.

3. Apparatus according to claim 2 wherein metal or metal alloy charge materials are preheated as they move down a shaft of the heating assembly by heat from a heating means moving up the shaft so as to form a counter flow heat exchanger.

4. Apparatus according to claim 3 wherein the metal or metal alloy charge materials are melted on a hearth and runs down a slope and into a holding bath of the heating assembly while oxide skin on the charge material remains on the hearth.

5. Apparatus according to claim 1 wherein the mould filling assembly includes a mould for forming an item to be cast from the metal or metal alloy, a crucible furnace to which the liquid metal or metal alloy is supplied from the transfer assembly, and a pump to move the metal or metal alloy into a cavity in the mould to fill the cavity.

6. Apparatus according to claim 5 wherein the liquid metal or metal alloy flows through a riser tube and into the mould cavity placed above the riser tube.

7. Apparatus according to claim 1 wherein the mould filling assembly includes a casting platen on which the mould is located and when the mould is filled with the metal or metal alloy, the mould is slid along the casting platen to a location to cool and solidify the metal or metal alloy and thereby free up the mould filling assembly to receive a new, empty mould.

8. Apparatus according to claim 1 wherein extraction of the bi-film sediment from a vessel or sump is via a riser tube, to an end of which is applied a vacuum to draw up the bi-film sediment through the riser tube.

9. Apparatus according to claim 8 wherein material which is emitted from a top of the riser tube is directed into a mould to solidify.

10. Apparatus according to claim 1 wherein a bubble lift mechanism is used to remove the bi-film sediment from a vessel or sump by imparting bubbles into molten material and which rise and move through a riser tube and carry a flocculant volume of sedimentation along with flow from the molten material.

11. Apparatus according to claim 1 wherein the launder includes an elongate channel at a predetermined height so as to minimise any fall of liquid flow from the heating assembly.

12. Apparatus according to claim 1 wherein a portion of the launder allows for separation of the bi-films sediment in the liquid metal or metal alloy material and the sediment separates from the flow and settles in a vessel or sump to concentrate the bi-film sediment at a location from where the bi-film sediment is extracted.

13. Apparatus according to claim 1 further comprising:

the mould filling assembly including a mould with a cavity therein, a furnace in which the liquid metal and/or metal alloy is located, a passage in a form of a riser tube connecting the furnace to the cavity to allow liquid metal to pass therealong and into the mould cavity when an ingate of the mould is in register with the riser tube, and wherein a support surface is provided and located so as to be substantially level with an interface between the ingate of the mould and the riser tube such that after filling of the mould cavity to a desired extent, a supply of liquid metal is closed off and the mould is moved by a sliding action from a position in register with the riser tube across the support surface to a position thereon which is sufficiently remote from the riser tube to allow a further mould to then be placed in connection with the riser tube.

14. Apparatus according to claim 13 wherein the supply of liquid metal and/or metal alloy is cut off by operation of a valve which is located at an end of the riser tube which opposes the end at which the interface with the mould is located.

15. Apparatus according to claim 13 wherein the furnace provides a reservoir of the liquid metal and/or metal alloy and a pump is provided which allows control of pressure of a supply of the liquid metal and/or metal alloy to the riser tube and mould cavity.

16. Apparatus according to claim 13 wherein a cooling apparatus is provided and/or the support surface is of a form so as to encourage solidification of the liquid metal and/or metal alloy in the filled mould, at least adjacent to the mould ingate and to a sufficient extent to then allow the filled mould to be lifted clear from the support surface as a subsequent step.

* * * * *